US009663258B2

(12) United States Patent
Sakoguchi et al.

(10) Patent No.: US 9,663,258 B2
(45) Date of Patent: May 30, 2017

(54) STACKING/WRAPPING APPARATUS

(71) Applicant: Kabushiki Kaisha Toshiba, Minato-ku, Tokyo (JP)

(72) Inventors: Yoshitaka Sakoguchi, Kawasaki (JP); Masakazu Itoya, Kawasaki (JP); Hidetake Suzuki, Kawasaki (JP); Kenichi Hirose, Minato-ku (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 747 days.

(21) Appl. No.: 13/742,908

(22) Filed: Jan. 16, 2013

(65) Prior Publication Data

US 2013/0180218 A1 Jul. 18, 2013

(30) Foreign Application Priority Data

Jan. 16, 2012 (JP) ..... 2012-006391

(51) Int. Cl.
*B65B 27/08* (2006.01)
*B65B 13/12* (2006.01)
(Continued)

(52) U.S. Cl.
CPC ..... *B65B 27/08* (2013.01); *B65B 13/12* (2013.01); *B65H 31/3045* (2013.01); *G07D 11/0081* (2013.01); *B65H 2301/43824* (2013.01)

(58) Field of Classification Search
CPC ..... B65B 35/50; B65B 13/20; B65B 13/18; B65B 13/12; B65B 13/10; B65B 27/08;
(Continued)

(56) References Cited

U.S. PATENT DOCUMENTS 4,111,116 A 9/1978 Ito et al.
4,511,301 A * 4/1985 Kawano et al. ..... B65B 27/08 271/213
(Continued)

FOREIGN PATENT DOCUMENTS

CN 1790426 A 6/2006
CN 101437723 A 5/2009
(Continued)

OTHER PUBLICATIONS

WIPO machine translation of WO2010109616, retrieved Sep. 17, 2015, 22 pages.*
(Continued)

*Primary Examiner* — Stephen F Gerrity
(74) *Attorney, Agent, or Firm* — Baker Botts L.L.P.

(57) ABSTRACT

According to one embodiment, a stacking/wrapping apparatus includes a stacking device configured to stack paper sheets in a predetermined number on a stacking unit, a wrapping device configured to wrap a bundle of the stacked paper sheets by winding a band thereon, and a transport carrier configured to receive the paper sheet bundle and transport the paper sheet bundle to the wrapping device. The wrapping device includes a hand assembly, a hand drive mechanism configured to open and close the hand assembly and reciprocate the hand assembly at right angles to the stacking direction, and a band winding device configured to wind a wrapper band around the paper sheet bundle drawn into the binding position.

12 Claims, 37 Drawing Sheets

(51) Int. Cl.
*G07D 11/00* (2006.01)
*B65H 31/30* (2006.01)

(58) Field of Classification Search
CPC ..... G07D 11/0081; B65H 31/3045; B65H 2301/4382; B65H 2301/43821; B65H 2301/43824
USPC ..... 53/528, 540, 588, 589; 100/26, 27
See application file for complete search history.

(56) References Cited

U.S. PATENT DOCUMENTS

| | | | | |
|---|---|---|---|---|
| 4,817,804 | A * | 4/1989 | Kawano et al. | B65B 27/08 209/534 |
| 4,870,807 | A * | 10/1989 | Palamides et al. | B65B 27/08 53/528 |
| 5,460,359 | A * | 10/1995 | Toyohara et al. | B65B 27/08 100/4 |
| 5,687,644 | A * | 11/1997 | Rann et al. | B65H 31/3045 100/156 |
| 2001/0028139 | A1* | 10/2001 | Neri | B65B 27/08 270/52.18 |
| 2002/0073651 | A1* | 6/2002 | Muller | B65B 27/08 53/399 |
| 2003/0226455 | A1 | 12/2003 | Dopfer et al. | |
| 2006/0076213 | A1* | 4/2006 | Sekiguchi et al. | G07D 11/0084 194/206 |
| 2011/0211202 | A1 | 9/2011 | Schmidt et al. | |

FOREIGN PATENT DOCUMENTS

| | | | | |
|---|---|---|---|---|
| CN | 102034297 | A | 4/2011 | |
| CN | 102101541 | A | 6/2011 | |
| DE | 2628608 | A1 * | 1/1977 | B65B 13/20 |
| EP | 1380506 | A2 * | 1/2004 | B65B 27/08 |
| JP | S62-23367 | U | 2/1987 | |
| JP | 04137093 | | 5/1992 | |
| JP | 09204550 | | 8/1997 | |
| JP | H11-79521 | A | 3/1999 | |
| JP | 2003-300501 | A | 10/2003 | |
| JP | 2005271957 | | 10/2005 | |
| WO | 2010109616 | | 9/2010 | |

OTHER PUBLICATIONS

JPO machine translation of JP 11-079521, retrieved Aug. 25, 2016, 7 pages.*

Search Report from the European Patent Office dated Apr. 16, 2013, for EP13151289, 5 pages.

Office Action issued in related Korean Patent Application No. 10-2013-0004786 mailed Aug. 21, 2014, 9 pages (with translation).

Office Action issued in related Chinese Patent Application No. 201310015993.5 mailed Sep. 2, 2014, 19 pages (with translation).

Office Action issued in related Japanese Patent Application No. 2013-005630 mailed Jun. 21, 2016, 8 pages (with translation.).

* cited by examiner

STACKING/WRAPPING APPARATUS

CROSS-REFERENCE TO RELATED APPLICATIONS

This application is based upon and claims the benefit of priority from Japanese Patent Application No. 2012-006391, filed Jan. 16, 2012, the entire contents of which are incorporated herein by reference.

FIELD

Embodiments described herein relate generally to a stacking/wrapping apparatus capable of stacking and wrapping paper sheets, such as bills, securities, etc.

BACKGROUND

In recent years, a large number of bills have been handled on a daily basis in the fields of banking business, large-scale retail trade, etc. There is a service to classify and arrange bills according to denomination and fitness (degree of damage). In handling a large number of bills, each 100 bills are normally wrapped or bound for safekeeping. A bill arranging apparatus is proposed as a system for automating such a bill arrangement service. The bill arranging apparatus comprises a hopper unit, transport mechanism, inspection unit, pocket units, stacking/wrapping apparatus, etc. Unclassified bills are stacked and accommodated in the hopper unit. The transport mechanism picks up the bills one by one from the hopper unit. The inspection unit inspects the transported bills for denomination and fitness levels. The inspected bills are classified by denomination and the like and stacked in the pocket units. The stacking/wrapping apparatus wraps or binds the bills stacked in piles of, for example, 100.

The stacking/wrapping apparatus generally comprises two stacking devices in which piles of 100 bills are stacked and a wrapping module disposed below them. The two stacking devices are arranged side by side. Further, the stacking/wrapping apparatus comprises a transport mechanism configured to transport the stacked bill bundles to the wrapping module. The transport mechanism comprises first and second carriers disposed for up-and-down motion in each of the stacking devices. The first carrier vertically transports the stacked bills. The second carrier is horizontally movable. The second carrier receives the bill bundles from each first carrier and transports and delivers them to the wrapping module.

In the stacking/wrapping apparatus constructed in this manner, the two stacking devices are arranged side by side, and the two second carriers are located therein. Therefore, a large installation space is required, so that the entire device is liable to be large. Since the two first carriers and two second carriers are independently operated, moreover, the operation of the entire device is complicated and may constitute a hindrance to higher-speed operation.

DETAILED DESCRIPTION

Various embodiments will be described hereinafter with reference to the accompanying drawings. In general, according to one embodiment, a stacking/wrapping apparatus comprises: a stacking device configured to stack paper sheets in a predetermined number on a stacking unit; a wrapping device configured to wrap a bundle of the stacked paper sheets by winding a band thereon; and a transport carrier configured to receive the paper sheet bundle stacked by the stacking device and transport the paper sheet bundle to the wrapping device. The wrapping device comprises a hand assembly capable of pinching end portions of the paper sheet bundle transported by the transport carrier and drawing the paper sheet bundle into a predetermined binding position, a hand drive mechanism configured to open and close the hand assembly in a stacking direction of the paper sheet bundle and reciprocate the hand assembly in a direction cross to the stacking direction, and a band winding device configured to wind a wrapper band around the paper sheet bundle drawn into the binding position. The transport carrier is configured to move to a receiving position facing the stacking device and receive another paper sheet bundle from the stacking device while the band is being wound around the paper sheet bundle by the wrapping device after the paper sheet bundle is grasped by the hand assembly.

Figure 1:
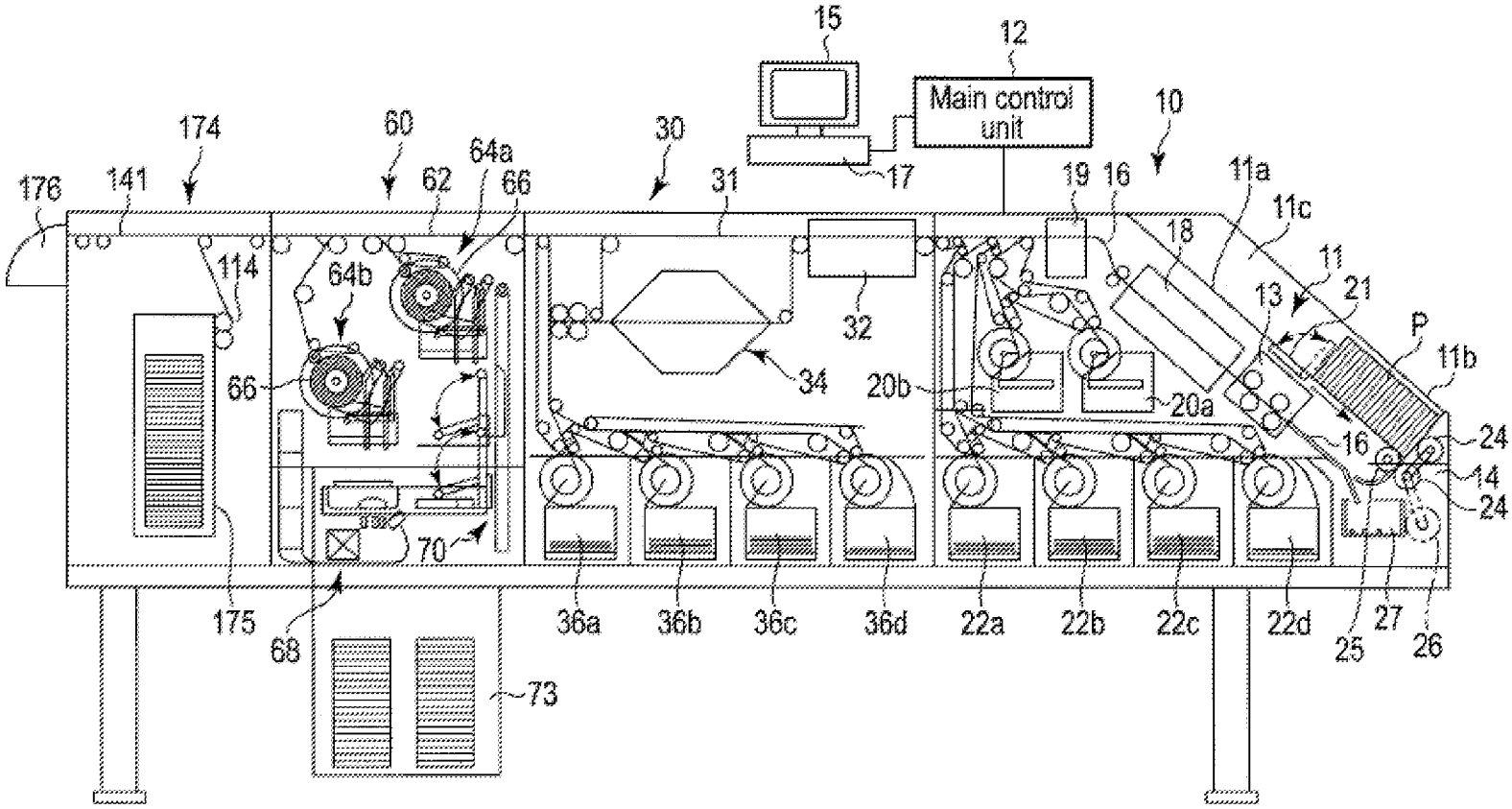
FIG. 1 is a sectional view showing a bill processing apparatus according to a first embodiment.

FIG. 1 is a sectional view schematically showing an outline of a bill processing apparatus according to an embodiment.

As shown in FIG. 1, the bill processing apparatus for processing bills as paper sheets comprises a main module 10, sorting module 30, stacking/wrapping module 60 for use as a stacking/wrapping apparatus, and large-capacity stacking module 174. These modules are arranged in a line and connected electrically and mechanically to one another. The main module 10 comprises a main control unit 12 configured to control the operations of the main module and the entire apparatus.

Figure 2:
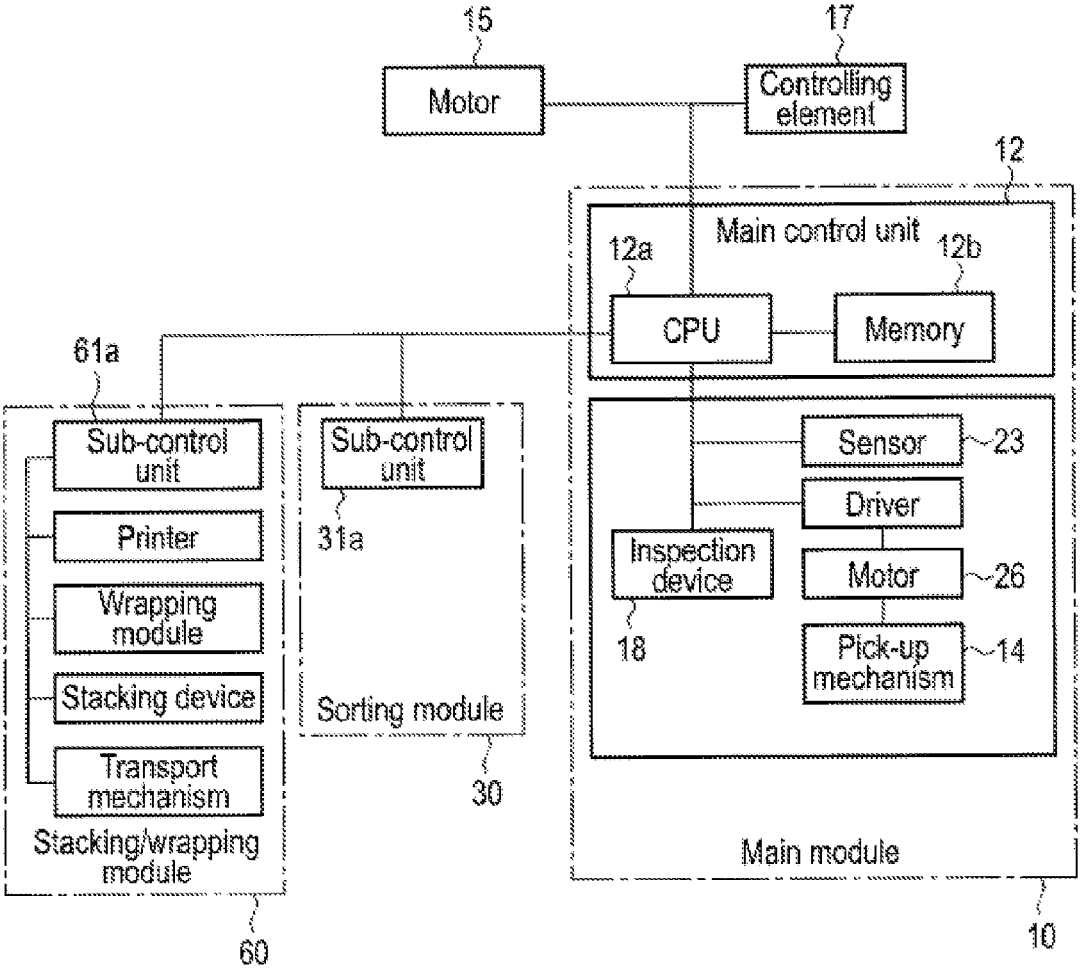
FIG. 2 is a block diagram schematically showing the bill processing apparatus.

As shown in FIGS. 1 and 2, the main control unit 12 is disposed on a control board in the main module 10. The main control unit 12 comprises a CPU 12*a* and memory 12*b*. The CPU 12*a* controls the operations of the individual modules and calculates the efficiency of the operating state and the like. The memory 12*b* stores various data, control programs, management information, etc. The various data include print information printable on a wrapper band, such as an operator ID, date/time, serial number, assignment information, bank logo, administrator's signature image, font, of language characters, etc., a plurality of processing speeds for the paper sheets, and the like, which are stored in the memory 12*b*.

The main control unit 12 is connected with a controlling element 17, configured to input various information to the apparatus, and a monitor 15 for use as a display device for displaying input information, operating state of the apparatus, processing state, etc. The sorting module 30 and stacking/wrapping module 60 comprise sub-control units 31*a* and 61*a*, respectively, for controlling the operations of the modules. These sub-control units are LAN-connected to the main control unit 12 through an interface and cable, neither of which is shown. The main control unit 12 is connected to a host computer (not shown) such that information is transferred and arranged between them.

Various operation settings for the processing apparatus are achieved by an operator's operation through the controlling element 17 connected to the main control unit 12. These settings include setting of methods of transactions, such as receipt of money, arrangement service, etc., loading into a loading chamber, inspection of bills in the loading chamber, setting of stacking chambers that accommodate processed bills P, setting of stacking and wrapping processes, setting of the fitness levels or discrimination levels for bills, and the like.

Based on processing information from an inspection device 18 (described later), moreover, the main control unit 12 calculates management data, including the processing efficiency per unit time, processing efficiencies for a plurality of days, processing efficiency for each operator ID, and total number of bills processed, loads them into the memory 12*b*, and displays them on the monitor 15.

As shown in FIG. 1, the main module 10 comprises a supply unit 11, pick-up mechanism 14, and transport path 16. A large number of bills P are stacked in the supply unit 11. The pick-up mechanism 14 picks up the bills P one by one from the supply unit 11. The bills P picked up by the pick-up mechanism 14 are transported through the transport path 16. A plurality of sets of endless conveyor belts (not shown) extend with the transport path 16 between them. The picked-up bills P are transported between the conveyor belts.

The supply unit 11 comprises a support surface 11*a*, extending inclined at an arbitrary angle to the vertical direction, mounting surface 11*b* extending substantially perpendicular to the support surface 11*a*, and a pair of guide walls 11*c* set up along the opposite sides of the mounting surface 11*b*. An output port through which the bills P are introduced into the apparatus is formed at the boundary between the support surface 11*a* and mounting surface 11*b*. The supply unit 11 is disposed in the main module 10 on one end side of the apparatus body, and its lower part, that is, the mounting surface 11*b*, is located near the lower end of the apparatus body.

A plurality (e.g., 2,000 or more) of bills P can be stacked in the supply unit 11. The lowermost one of the stacked bills P is placed on the mounting surface 11*b*, and the bills P are slantingly mounted on the mounting surface 11*b* in such a manner that, for example, their longer side edges are arranged along the support surface. The stacked bills P are introduced one after another into the apparatus through an output port 11*e*, the lowermost one first, by the pick-up mechanism 14.

The tilt angle of the support surface 11*a* is set within the range of 25 to 75°, e.g., 30 to 40°. The support surface 11*a* may be configured to be pivotable relative to the apparatus body so that its tilt angle is adjustable.

The supply unit 11 comprises a backup plate 21 configured to move the stacked bills P to the pick-up side or toward the mounting surface 11*b*. The backup plate 21 is movable along the support surface 11*a* so that it can be accommodated in the support surface. The backup plate 21 is pivotably supported by the support surface 11*a*. Normally, in the case where about 2,000 bills P are placed in the supply unit 11, for example, the backup plate 21 is accommodated in such a position that it is substantially flush with the support surface 11*a* and held in the position by a torsion spring or the like. As the pick-up of the bills P advances so that the number of bills is reduced to, for example, about 300, the backup plate 21 is pivoted to a position where it stands upright on the support surface 11*a*. Thereafter, the backup plate 21 abuts the uppermost one of the stacked bills P and moves together with the bills P to the pick-up side. Thus, the backup plate 21 can move the stacked bills P to the pick-up side. Even when the remaining stacked bills P are scarce, they can be prevented from falling down and reliably moved to a pick-up position.

The pick-up mechanism 14 that picks up the bills P one by one from the supply unit 11 comprises a plurality of pick-up rollers 24, separation rollers 25, and drive motor 26. The pick-up rollers 24 are arranged so that they can abut the bills P on the mounting surface 11*b*, and the separation rollers 25 are arranged in rolling contact with the pick-up roller 24 on the pick-up port side. The drive motor 26 rotates the pick-up rollers 24 at a predetermined speed.

As the pick-up rollers 24 rotate, they pick up the lowermost bill P and deliver it to the transport path 16 through the output port lie. As this is done, the second and subsequent bills P are separated from the picked-up bill by the separation rollers 25. In this way, the bills P are picked up one by one from the supply unit 11 and delivered to the transport path 16.

As shown in FIG. 1, a pitch correction unit 13 configured to correct the transport pitch of the bills P transported through the transport path 16, the inspection device 18 configured to inspect the bills P with the corrected transport pitch one by one, and a barcode reader 19 are arranged along the transport path 16. The inspection device 18 is located above the output port of the supply unit 11 with respect to the vertical direction. The inspection device 18 detects the denomination, shape, thickness, side (obverse or reverse), authenticity, fitness, double pick-up, etc., of the delivered bills P. The fitness detection is based on discrimination between bills fit for recirculation and unfit bills, which are soiled or damaged and unfit for recirculation. In the case where a batch card is used, for example, the barcode reader 19 reads barcodes affixed to the batch card or casino ticket passed through the inspection device 18 and delivers the read information to the main control unit 12.

The transport path 16 first extends downward from the pick-up mechanism 14 and the output port and then extends upward to the inspection device 18 at an angle to the vertical direction. The transport path 16 connects with the sorting module 30, which will be described later. According to the present embodiment, the transport path 16 extends substantially along the support surface 11*a* of the supply unit 11, that is, inclined in the same manner as the support surface 11*a*. Alternatively, the transport path 16 may extend obliquely upward relative to and directly from the output port without first extending downward therefrom. The inspection device 18 also obliquely extends along the transport path 16. An exit is formed at the lowermost part of the transport path 16, and a foreign matter collection box 27 is disposed below the exit. Foreign matter dropping along the transport path 16 is discharged through the exit and collected in the collection box 27.

In the main module 10, as shown in FIG. 1, two rejection units 20*a* and 20*b* are disposed along the transport path 16, and a plurality of stacking chambers 22*a*, 22*b*, 22*c* and 22*d* in which the bills are stacked are arranged side by side. The bills P passed through the inspection device 18 are classified into two groups, rejected bills and processable bills, by a gate (not shown). The rejected bills are those which are determined to be counterfeit or unidentifiable, due to a fold, break, skew, double pick-up, etc., by the inspection device 18. The skew is a situation where the bills P are inclined relative to the direction perpendicular to the transport direction. The rejected bills are distributed and stacked in the rejection unit 20*a* or 20*b*. All the rejected bills stacked in the rejection unit 20*a* or 20*b*, except counterfeit ones, are reset and re-introduced into the supply unit 11 or included into enumeration data by manual input. Results of inspection of the transacted amount of money, number of bills, etc., by the inspection device 18 are delivered to and stored in the main control unit 12 and displayed on the monitor 15.

The processable bills are those which are determined to be fit or unfit authentic bills by the inspection device 18. The processable bills are delivered to and stacked in the stacking chambers 22*a* to 22*d*. For example, the processable bills are distributed and stacked in one of the stacking chambers 22*a* to 22*d* corresponding to each denomination, while the unfit bills are collectively stacked in one of the stacking chambers.

In the case where a batch card is used, it is delivered to and stacked in the rejection unit 20*a* or 20*b* after passing through the inspection device 18 and barcode reader 19.

The main module 10 comprises various sensors, as well as a drive mechanism and power supply (not shown) for driving the pick-up mechanism 14, the inspection device 18, a transport mechanism, etc.

As shown in FIG. 1, the sorting module 30 comprises a transport path 31, sorting mechanism 32, inverting device 34, and stacking chambers 36*a*, 36*b*, 36*c* and 36*d*. The transport path 31 serves to transport the bills P delivered from the main module 10. The sorting mechanism 32 is disposed upstream relative to the transport path 31. The inverting device 34 is disposed downstream relative to the sorting mechanism 32 along the transport path 31. The stacking chambers 36*a* to 36*d* are arranged side by side along the transport path 31.

The sorting mechanism 32 aligns the centers of the bills P delivered through the transport path 31 with the center of the transport path 31 and corrects a skewed bill so that its one side is oriented perpendicular to the transport direction. The inverting device 34 inverts the orientation of each bill P delivered through the transport path 31, thereby delivering it in such a manner that its obverse and reverse are lined up in an arbitrarily specified direction.

The bills P delivered from the sorting mechanism 32 or those lined up and delivered from the inverting device 34 are fed to the stacking/wrapping module 60 through the transport path 31 or fed to and stacked in one of the stacking chambers 36*a* to 36*d*. The stacking chambers 36*a* to 36*d* of the sorting module 30 can be used as chambers in which the bills are stacked for each denomination. Alternatively, the stacking chambers 36*a* to 36*d* can be used as rejected or unfit bill chambers in which the rejected or unfit bills removed from the main module 10 are stacked.

In the case where a wrapping process is set, on the other hand, the fit or unfit bills removed from the main module 10 or sorting module 30 are delivered to the stacking/wrapping module 60 through the transport path 31 of the sorting module 30 and stacked and wrapped in a predetermined number at a time. As this is done, the sorting module 30 aligns the centers of the bills delivered through the transport path 31 with the center of the transport path and corrects a skewed bill so that its one side is oriented perpendicular to the transport direction. As the positional relationship between the bills to be wrapped is settled by the sorting module 30, the bills are neatly stacked and wrapped by the stacking/wrapping module 60.

Figure 3:
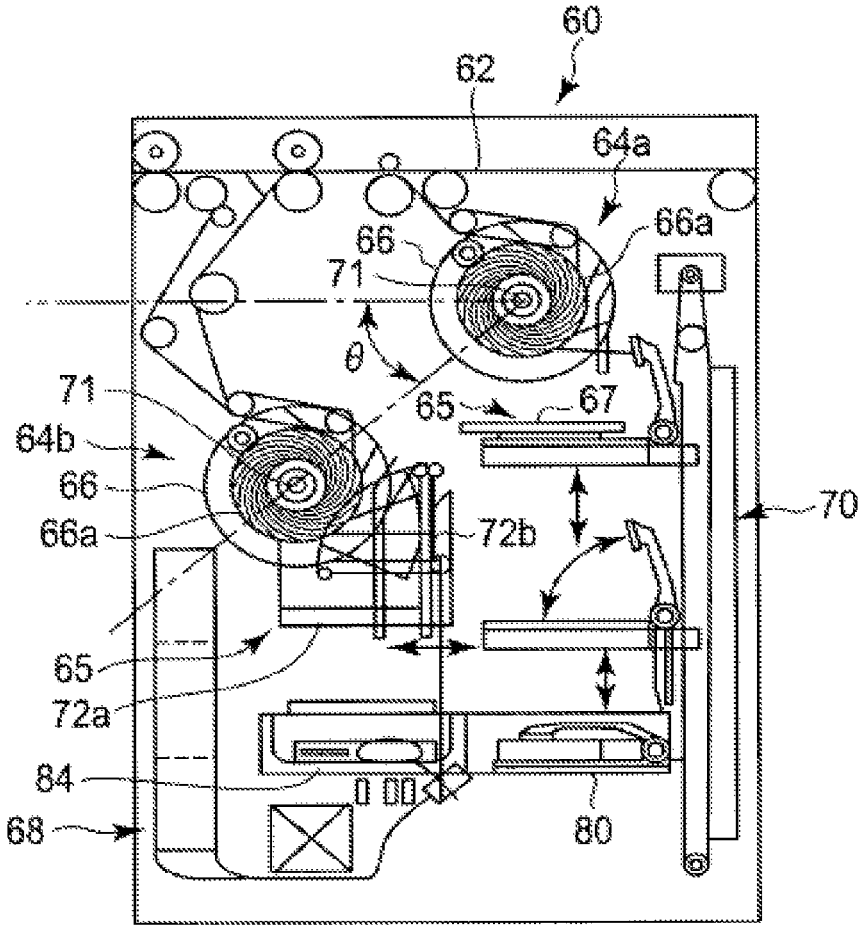
FIG. 3 is a sectional view showing a stacking/wrapping module of the bill processing apparatus.
Figure 4A:
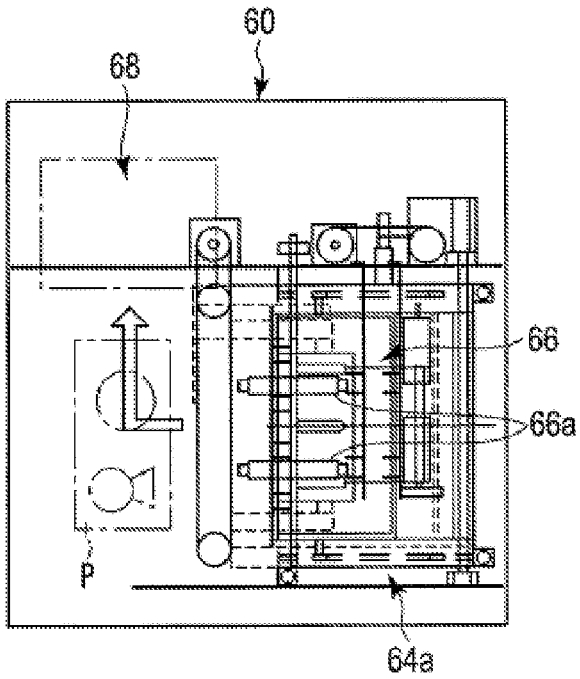
FIGS. 4A and 4B are plan views showing first and second stacking devices, respectively, of the stacking/wrapping module.
Figure 4B:
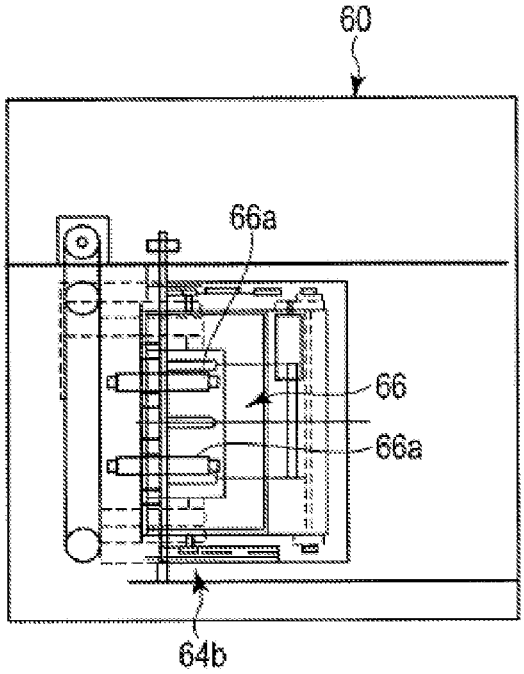

FIGS. 3 and 4 are front and plan views, respectively, of the stacking/wrapping module 60 for use as a stacking/wrapping apparatus. As shown in FIGS. 1, 3 and 4, the stacking/wrapping module 60 comprises a transport path 62, first and second stacking devices 64*a* and 64*b*, wrapping device 68, and transport mechanism 70. The transport path 62 communicates with the transport path 31 of the sorting module 30. A predetermined number of bills delivered through the transport path 62 are stacked in each of the first and second stacking devices 64*a* and 64*b*. The wrapping device 68 wraps a predetermined number (e.g., 100) of bills in a bundle stacked by each stacking device with a wrapper band. The transport mechanism 70 transports the bundles of bills stacked by the first and second stacking devices 64*a* and 64*b* to the wrapping device 68. Further, a discharge unit 73 that receives and stacks the bill bundles wrapped by the wrapping device 68 is disposed below the wrapping device.

The first and second stacking devices 64*a* and 64*b* are offset vertically and horizontally from each other. The second stacking device 64*b* is offset obliquely downward relative to the first stacking device 64*a* at an angle θ of, for example, about 10 to 80°, partially overlapping the first stacking device 64*a* in the vertical direction. The wrapping device 68 is located below the second stacking device 64*b*.

Each of the first and second stacking devices 64*a* and 64*b* comprises a temporary stacking unit 65 and impeller stacking device 66 configured to stack a predetermined number of delivered bills P one by one in the temporary stacking unit 65. An impeller 66*a* of the impeller stacking device 66 comprises a plurality of blades incorporated around an axis of rotation and is rotated synchronously with the transport of the bills P so that the bills P can be received between the blades. By means of the impeller 66*a*, the kinetic energy of the quickly transported bills P is absorbed as the bills are aligned and stacked in the temporary stacking unit 65.

The temporary stacking unit 65 of the first stacking device 64*a* comprises a first shutter 67 capable of, for example, opening and closing horizontally. The bills P are stacked on the first shutter 67 in a closed position. The temporary stacking unit 65 comprises a horizontal support block 72*a* on which the bills P are stacked and a second shutter 72*b* configured to abut the long sides of the stacked bills, thereby aligning the transverse position of the bills. The second shutter 72*b* is pivotable between an alignment position where it aligns the bills P and an open position where it allows the passage of the stacked bill bundle.

Further, each of the first and second stacking devices 64*a* and 64*b* comprises an indicator 71, such as an LED, configured to display processing states of the apparatus, such as errors, coefficient states, etc., of the stacking devices. These indicators 71 are disposed in positions where they can be easily viewed from the outside when an external cover of the stacking/wrapping module 60 is opened, for example. The indicators 71 inform the operator of various processing states of the stacking devices, such as the need of bill recharge, occurrence of errors, and identity of bills, by flickering, lighting, extinction, or different colors.

Figure 5:
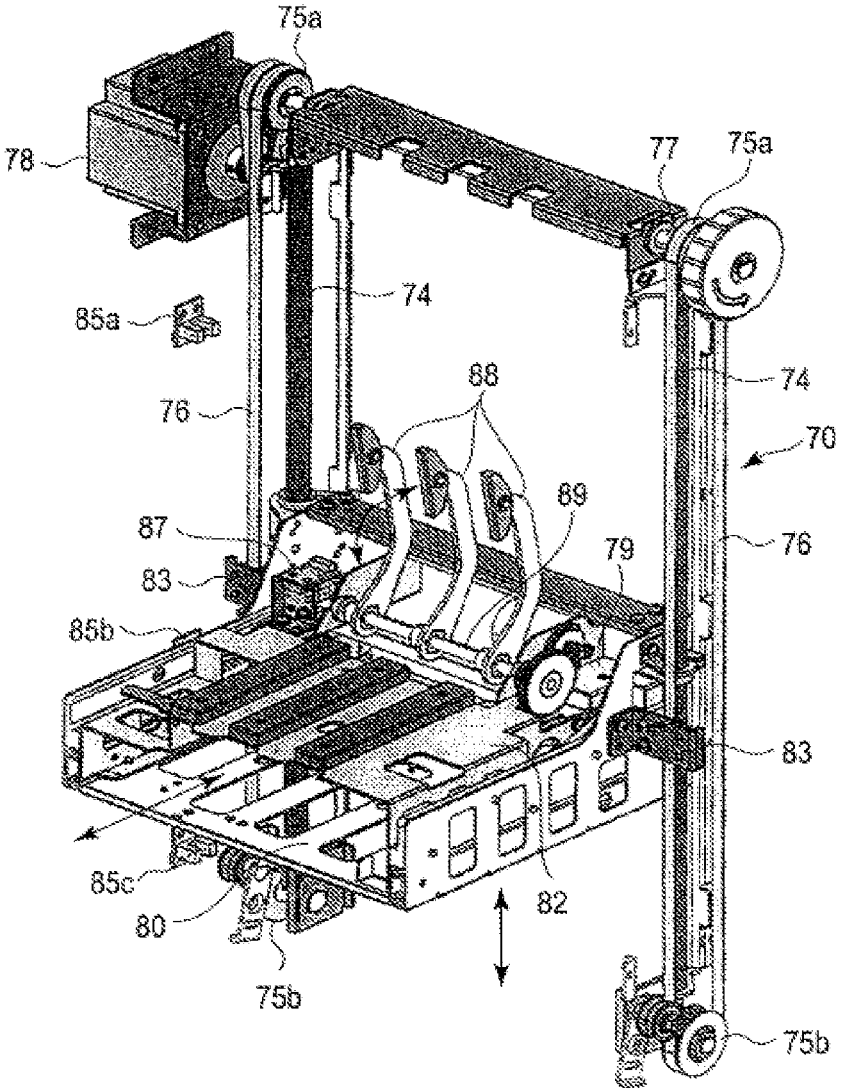
FIG. 5 is a perspective view showing a transport mechanism of the stacking/wrapping module.

As shown in FIGS. 3 and 5, the transport mechanism 70, which transports the bill bundles between the wrapping device 68 and the first and second stacking devices 64*a* and 64*b*, comprises a pair of guide rods 74, pulleys 75*a* and 75*b*, drive belts 76, connecting shaft 77, motor 78, base carrier 80, and sheet carrier (transport tray) 82. The guide rods 74 are set up vertically. The pulleys 75*a* and 75*b* are disposed on the upper and lower ends, respectively, of the guide rods. The drive belts 76 are passed around and vertically extend between their corresponding pulleys 75*a* and 75*b*. The connecting shaft 77 connects the two upper pulleys 75*a*. The motor 78 drives one of the upper pulleys 75*a* to vertically run the pair of drive belts 76. The base carrier 80 can ascend and descend along the guide rods 74. The sheet carrier 82 is disposed for horizontal reciprocation on the base carrier 80. The base and sheet carriers 80 and 82 constitute a transport carrier.

The base carrier 80 is in the form of a substantially rectangular tray, one end portion of which is supported by the guide rods 74 and guided for up-and-down motion along the guide rods. The base carrier 80 extends substantially horizontally. Further, the base carrier 80 is connected to the drive belts 76 by a pair of brackets 83. As the motor 78 is driven forward or reverse, the drive belts 76 vertically run, thereby causing the base carrier 80 to ascend and descend. The base carrier 80 is moved up and down between a first position where it is adjacently opposed to the first shutter 67 of the first stacking device 64*a* from below, a second position where it laterally faces the support block 72*a* of the second stacking device 64*b*, and a third position where it laterally faces a release block 84 (described later) of the wrapping device 68. Position sensors 85*a*, 85*b* and 85*c*, such as photo-interrupters, are disposed individually in these positions. As the base carrier 80 is detected by these position sensors, it can be moved to and located in one of these positions.

On the other hand, the sheet carrier 82 is in the form of, for example, a rectangular plate larger than each bill P and is configured to carry the stacked bills thereon. The sheet carrier 82 is disposed for horizontal reciprocation on the base carrier 80. Specifically, the sheet carrier 82 is disposed on the base carrier 80 so that it can reciprocate between a standby position shown in FIG. 5 and an advanced position, across the movement direction of the base carrier 80, that is, horizontally. In the standby position, the sheet carrier 82 is superposed on the base carrier 80. In the advanced position, the sheet carrier 82 extends substantially horizontally from the front end of the base carrier. The base carrier 80 carries thereon a drive source 87, such as a motor or plunger, configured to horizontally move the sheet carrier 82.

The sheet carrier 82 is provided with a plurality of bill clampers 88 configured to hold each bill bundle on the sheet carrier. These bill clampers 88 are mounted on a rotating shaft 89 supported by the sheet carrier 82. As the rotating shaft 89 is pivoted by a drive motor 79 on the sheet carrier 82, the bill clampers 88 are pivoted between an open position where they are separated from the support surface of the sheet carrier 82, as shown in FIG. 5, and a clamping position where they presses the bill bundle against the sheet carrier 82 from above, thereby holding the bill bundle in a sandwiching manner.

Figure 6:
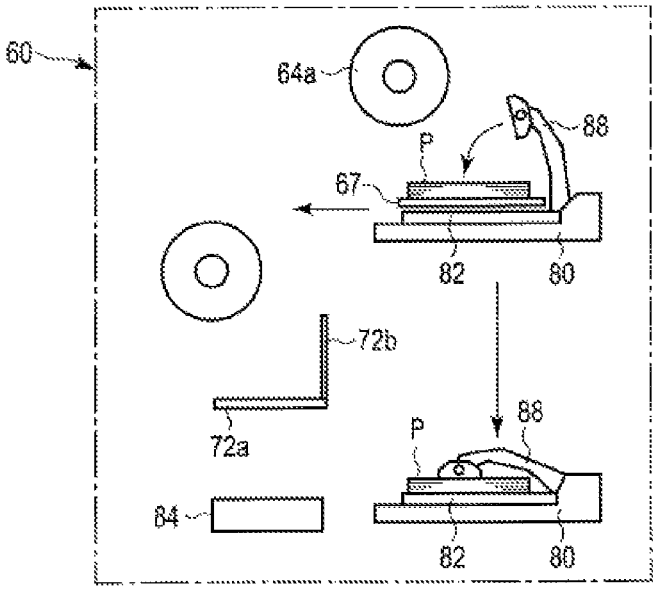
FIG. 6 is a view schematically showing a first operating state of the transport mechanism.

The stacking of the bills by the first and second stacking devices 64*a* and 64*b* and the transport of the bill bundles by the transport mechanism 70 are performed in the following manner. As shown in FIG. 6, for example, a predetermined number (e.g., 100) of bills of the same denomination are stacked on the first shutter 67 by the first stacking device 64*a*. When this is done, the base carrier 80 is kept on standby in the first position such that the sheet carrier 82 thereon is adjacently opposed to the first shutter 67 from below. If the 100 bills P are stacked on the first shutter 67, the first shutter moves to its open position, whereupon the stacked bills P are placed on the sheet carrier 82. After the stacked bill bundle is then pressed and held on the sheet carrier 82 by the bill clampers 88, the base carrier 80 is lowered to the third position. Thereafter, the first shutter 67 is returned to its original stacking position.

Figure 7:
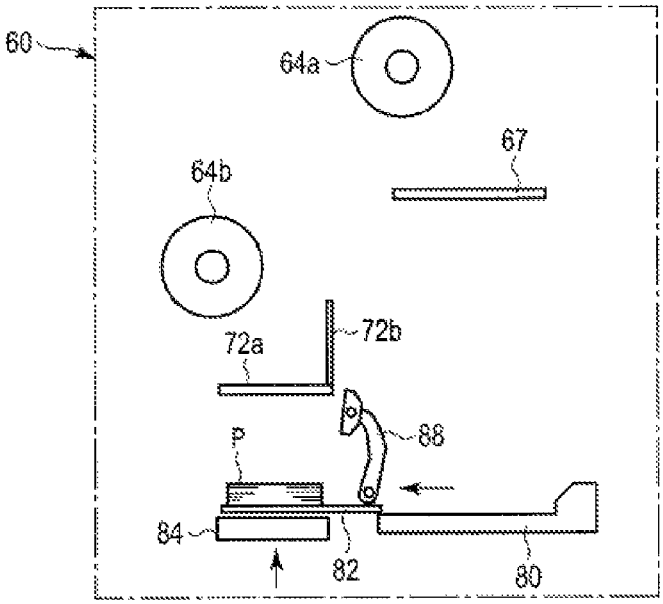
FIG. 7 is a view schematically showing a second operating state of the transport mechanism.

Then, as shown in FIG. 7, the sheet carrier 82 is advanced from the standby position to the advanced position, whereupon the stacked bill bundle is moved to a region above the release block 84 of the wrapping device. Subsequently, one longitudinal end portion of each stacked bill bundle is held by a hand assembly of a grasping/drawing mechanism (described later) of the wrapping device 68, and the bill clampers 88 are opened to release the hold. Thereafter, the sheet carrier 82 is moved from the advanced position to the standby position. In this way, the bundle of stacked bills P is delivered to the wrapping device 68.

Figure 8:
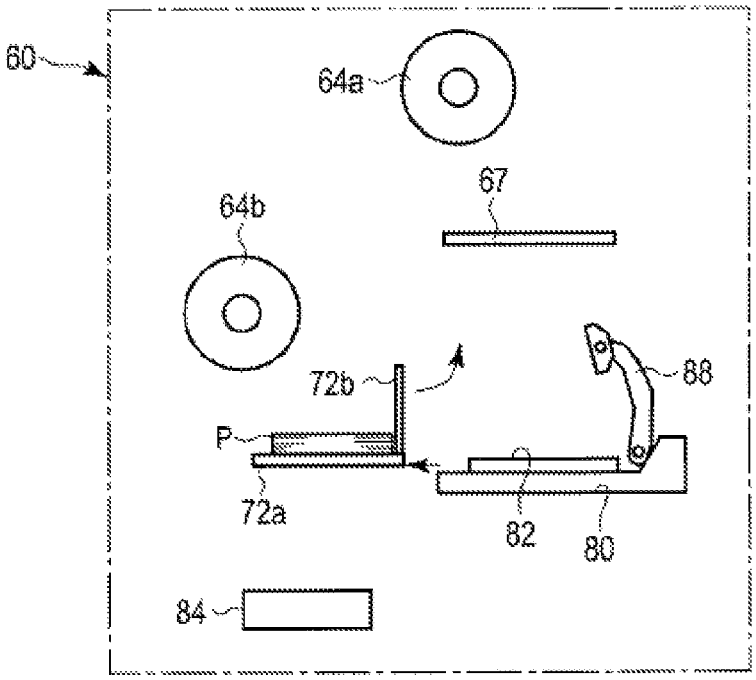
FIG. 8 is a view schematically showing a third operating state of the transport mechanism.
Figure 9:
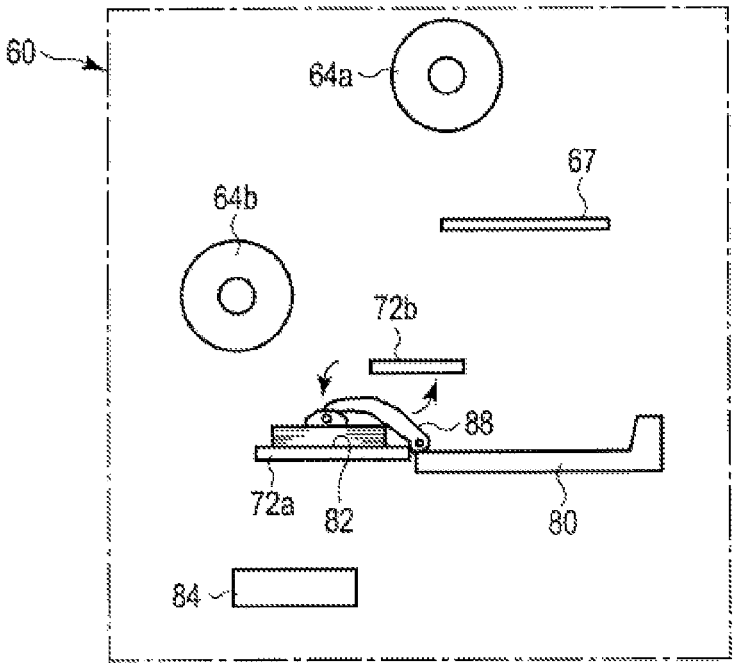
FIG. 9 is a view schematically showing a fourth operating state of the transport mechanism.

After the 100 bills are stacked by the first stacking device 64*a*, on the other hand, the 101-st and subsequent bills are delivered to the second stacking device 64*b*, and a predetermined number (e.g., 100) of bills are stacked on the support block 72*a* by the second stacking device 64*b*, as shown in FIG. 8. When this is done, the second shutter 72*b* is in the illustrated alignment position, where it aligns the transverse position of the stacked bills. Further, the base carrier 80 is kept on standby in the second position where it laterally faces the support block 72*a*. If the 100 bills P are stacked on the support block 72*a*, the sheet carrier 82 advances from the standby position to the advanced position, whereupon it is nested into the support block 72*a* and located below the stacked bills P. Subsequently, the second shutter 72*b* is pivoted to the open position, where it allows the passage of the stacked bill bundle P, as shown in FIG. 9.

Figure 10:
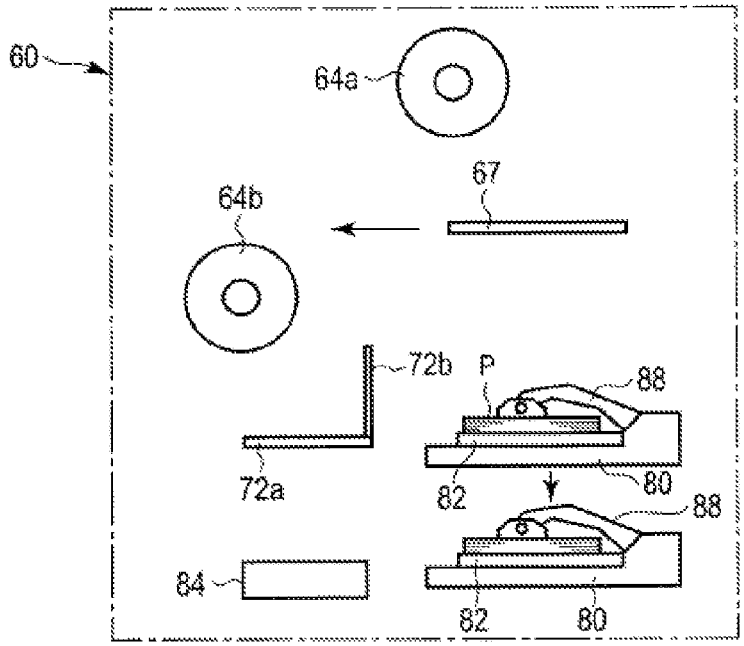
FIG. 10 is a view schematically showing a fifth operating state of the transport mechanism.

After the stacked bills P are pressed and held on the sheet carrier 82 by the bill clampers 88 in this state, the sheet carrier 82 is returned to the standby position, as shown in FIG. 10, and the sheet carrier 82 and stacked bills are moved onto the base carrier 80. Then, the sheet and base carriers 82 and 80 are lowered to the third position. The second shutter 72*b* is returned to its original alignment position.

Figure 11:
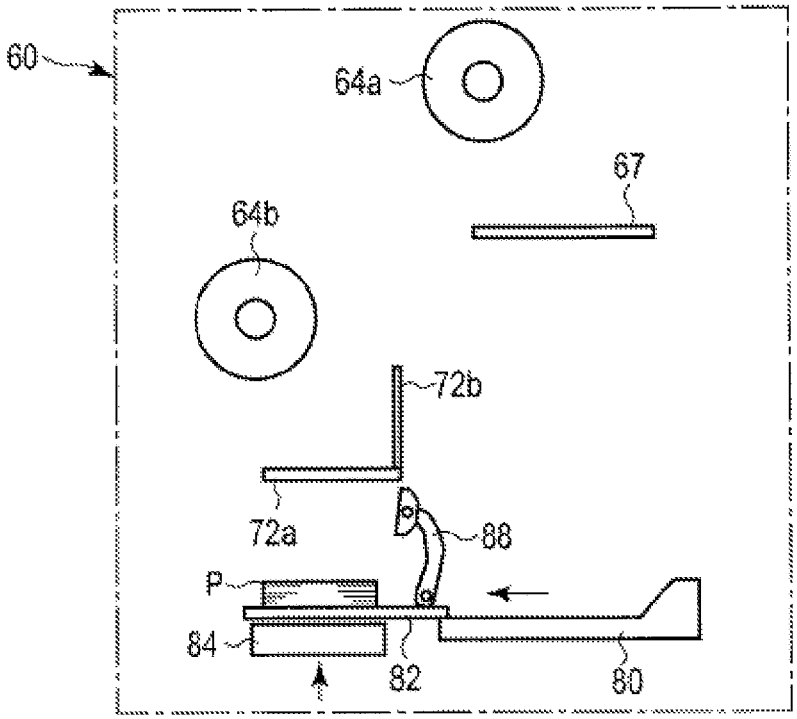
FIG. 11 is a view schematically showing a sixth operating state of the transport mechanism.

Subsequently, as shown in FIG. 11, the sheet carrier 82 in the third position is advanced from the standby position to the advanced position, whereby the stacked bill bundle is moved to the region above the release block 84 of the wrapping device. Then, one longitudinal end portion of the stacked bill bundle P is held by the hand assembly of the grasping/drawing mechanism of the wrapping device 68, and the bill clampers 88 are opened to release the hold. Thereafter, the sheet carrier 82 is moved from the advanced position to the standby position. In this way, the stacked bills P are delivered to the wrapping device 68.

Figure 12:
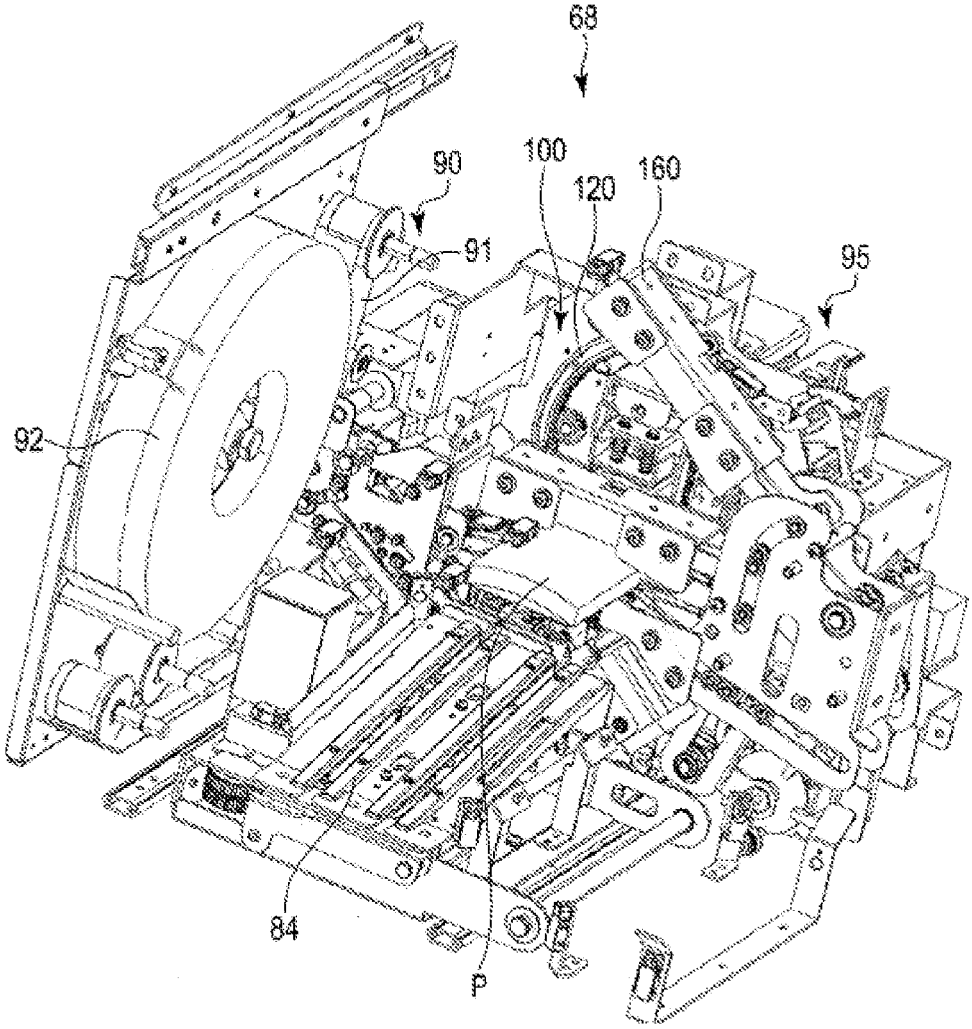
FIG. 12 is a perspective view schematically showing the whole of a wrapping device of the stacking/wrapping module.
Figure 13:
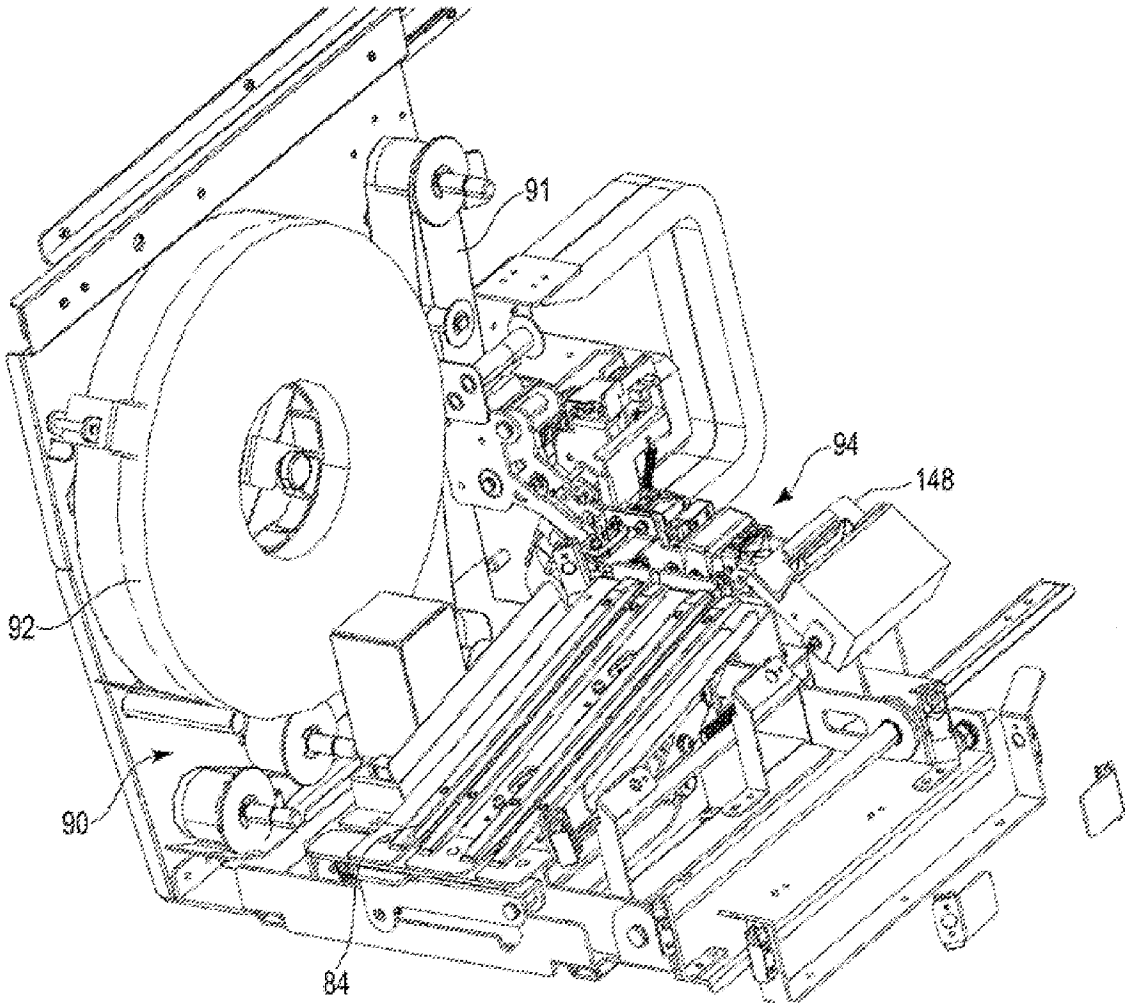
FIG. 13 is a perspective view showing a release block and band feeder of the wrapping device.
Figure 14:
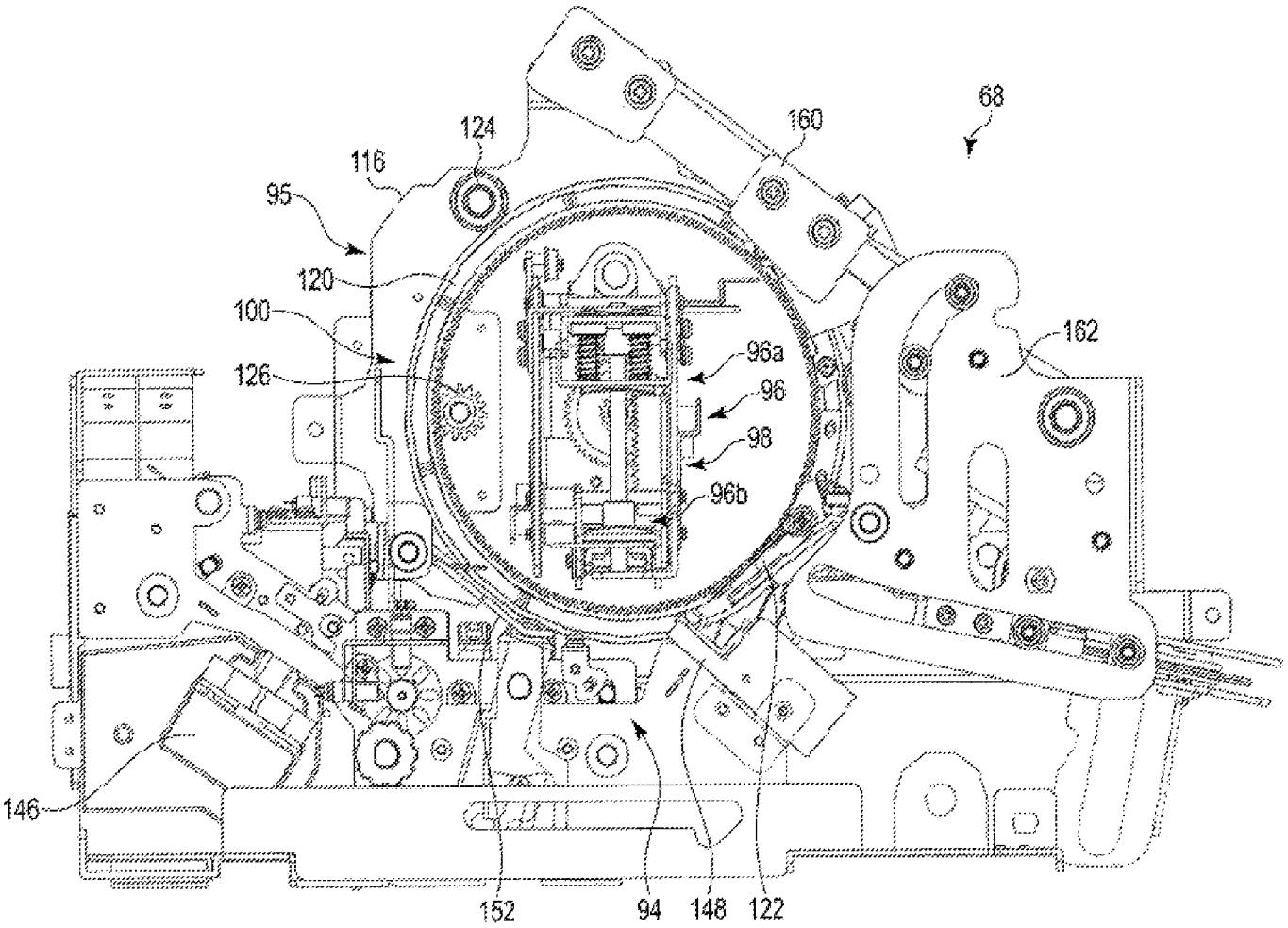
FIG. 14 is a front view showing the whole of a band winding device with a hand assembly of the wrapping device open and with an upper clamper raised.
Figure 15:
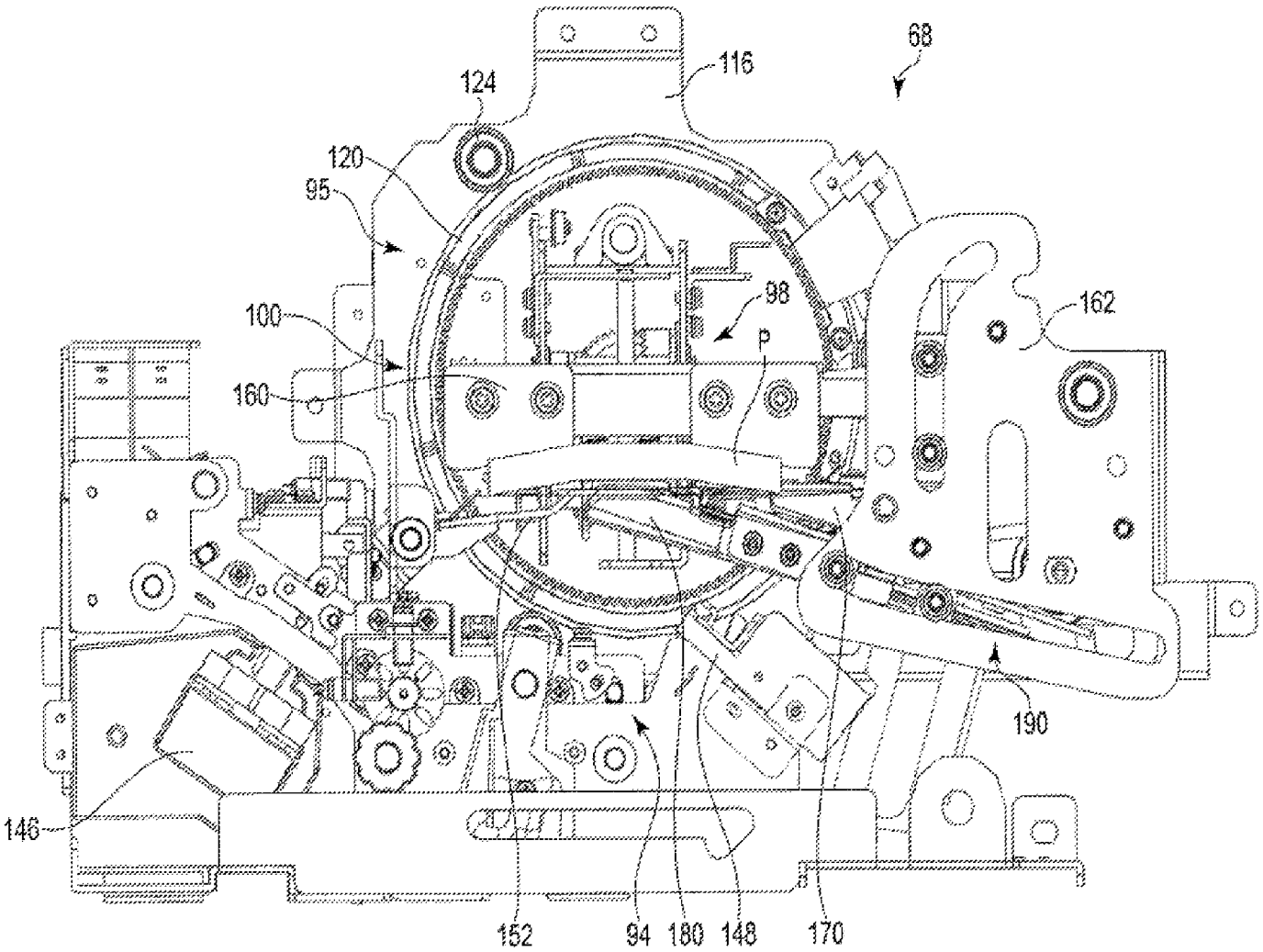
FIG. 15 is a front view showing the whole of the band winding device with the hand assembly of the wrapping device closed and with a second band retainer and heater in a retaining position and heat-sealing position, respectively.

The following is a description of the wrapping device 68. FIG. 12 is a perspective view schematically showing the entire wrapping device 68. FIG. 13 is a perspective view showing a band feeder and the release block of the wrapping device. FIGS. 14 and 15 are front views showing a binding mechanism of the wrapping device.

As shown in FIGS. 12 and 13, the wrapping device 68 comprises the substantially rectangular release block 84, which is declined relative to a horizontal plane, and a band feeder 90 configured to deliver a wrapper band. The stacked bill bundle P is introduced into a region above the release block 84. The band feeder 90 comprises a band reel 92 wound with a wrapper band 91 for wrapping the stacked bill bundle and a band feed mechanism 94 configured to draw out the wrapper band 91 from the band reel 92 and deliver it in a loop. The band feed mechanism 94 will be described in detail later.

As shown in FIGS. 12, 14, and 15, a binding mechanism 95 of the wrapping device 68 comprises a movable hand assembly 96, hand drive mechanism 98, and band winding device 100. The hand assembly 96 pinches the center of one longitudinal end portion of the stacked bill bundle P transported to the region above the release block 84 by the sheet carrier 82 (transport carrier) and draws the bill bundle into a predetermined binding position. The hand drive mechanism 98 opens and closes the hand assembly 96 in the stacking direction of the bill bundle and reciprocates the bill bundle at right angles to the stacking direction. The band winding device 100 winds the wrapper band around the stacked bill bundle P drawn into the binding position.

As the wrapper band 91 is wound around the stacked bill bundle P by the wrapping device 68 after it is grasped by the hand assembly 96, the sheet carrier 82 moves to a receiving position where it faces the first or second stacking device 64*a* or 64*b* and receives the next stacked bill bundle from the stacking device.

Figure 16:
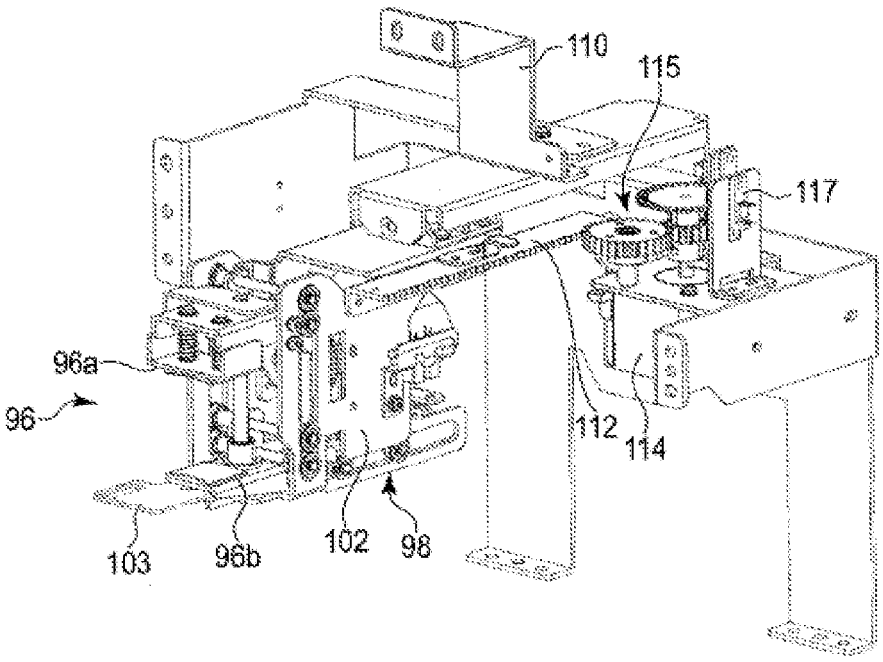
FIG. 16 is a perspective view showing the hand assembly and a hand drive mechanism.
Figure 17:
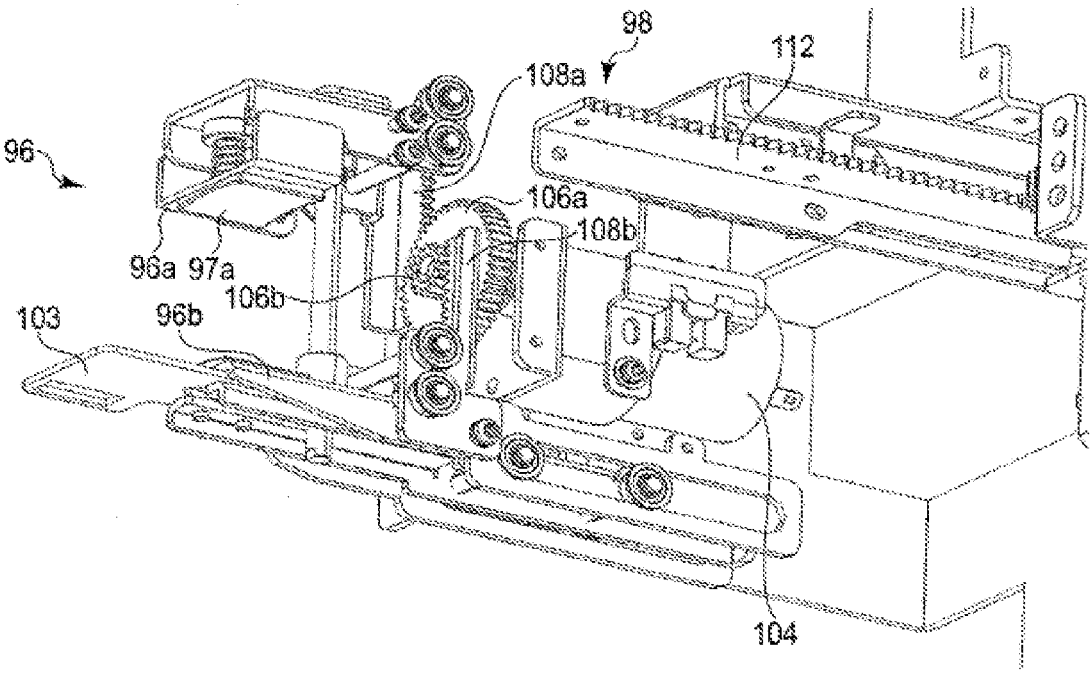
FIG. 17 is a perspective view showing the hand assembly and hand drive mechanism.

As shown in FIGS. 16 and 17, the hand assembly 96 comprises upper and lower hands 96*a* and 96*b*, which are opposed to each other in substantially parallel relation with a gap therebetween and individually supported for up-and-down motion by a support frame 102. These upper and lower hands 96*a* and 96*b* are substantially in the form of plates extending substantially horizontally. An upwardly concave pressure pad 97*a* is mounted on the lower surface of the upper hand 96*a*. An upwardly convex pressure pad 97*b* is mounted on the upper surface of the lower hand 96*b*. Further, a support plate 103, which serves as an ironing board (described later), is disposed on the lower surface side of the lower hand 96*b*, extending substantially horizontally from the lower hand. The support plate 103 is made of, for example, stainless steel.

The hand drive mechanism 98 comprises a first motor 104 mounted on the support frame 102, large and small coaxial gears 106*a* and 106*b*, and first and second racks 108*a* and 108*b*. The small gear 106*b* is smaller in diameter than the large gear 106*a*. The gears 106*a* and 106*b* are rotated about the same axis, that is, a horizontal axis in this case, by the first motor. The first rack 108*a* is connected to the upper hand 96*a* and meshes with the large gear 106*a*. The second rack 108*b* is connected to the lower hand 96*b* and meshes with the small gear 106*b*. The racks 108*a* and 108*b* individually extend vertically and are located parallel to each other with the respective rotating shafts of the gears 106*a* and 106*b* between them.

Figure 18:
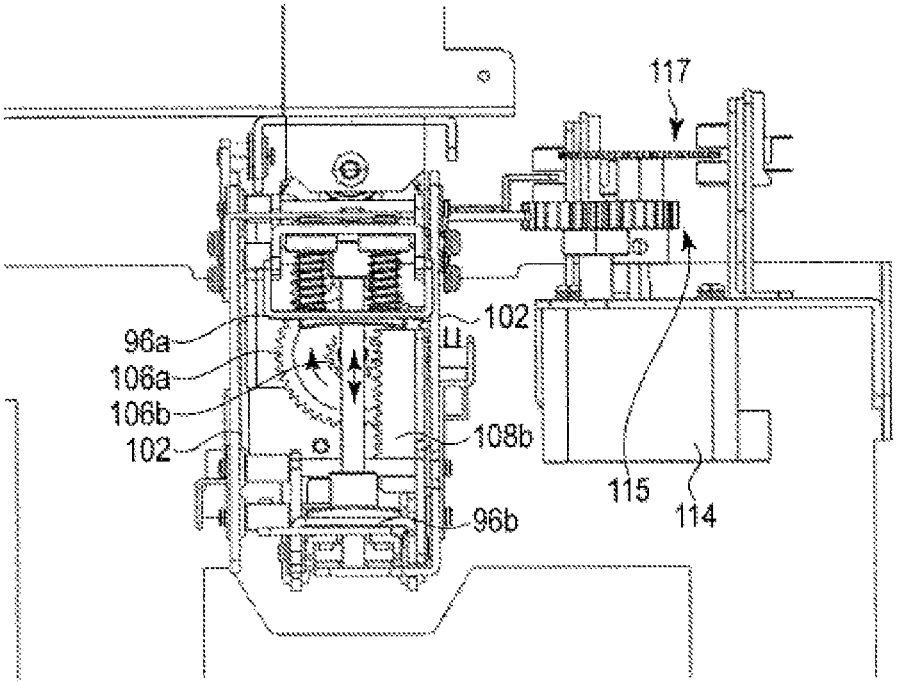
FIG. 18 is a front view showing the hand assembly and hand drive mechanism in an open position.
Figure 19:
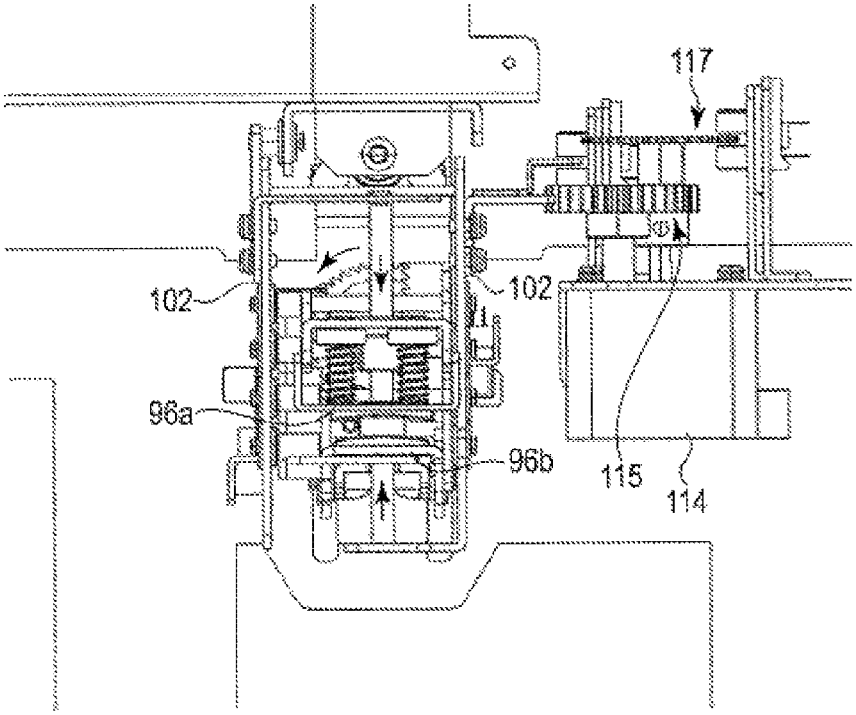
FIG. 19 is a front view showing the hand assembly and hand drive mechanism in a closed position.

As the large and small gears 106*a* and 106*b* are rotated in one direction (or clockwise direction) by the first motor 104, as shown in FIG. 18, the upper and lower hands 96*a* and 96*b* ascend and descend, respectively, and move away from each other to their respective open positions. As the large and small gears 106*a* and 106*b* are rotated in the other direction (or counterclockwise direction) by the first motor 104, as shown in FIG. 19, in contrast, the upper and lower hands 96*a* and 96*b* descend and ascend, respectively, and move toward each other to their respective closed positions.

Since the upper and lower hands 96*a* and 96*b* are driven up and down by the large and small gears 106*a* and 106*b*, respectively, as described above, the amount of up-and-down motion of the upper hand 96*a* is greater than that of the lower hand 96*b*. Thus, the operating quantity of the upper hand is greater than that of the lower hand, so that thick or swollen bills can be easily received and reliably clamped.

As shown in FIGS. 16 and 17, the support frame 102 supporting the hand assembly 96 is supported for horizontal reciprocation by a base frame 110. Further, a horizontally extending rack 112 is secured to the support frame 102. The hand drive mechanism 98 comprises a second motor 114 mounted on the base frame 110, gear train 115 engaging with the rack 112 and the shaft of the motor, and a sensor 117 configured to detect the rotational position of the motor.

Figure 20:
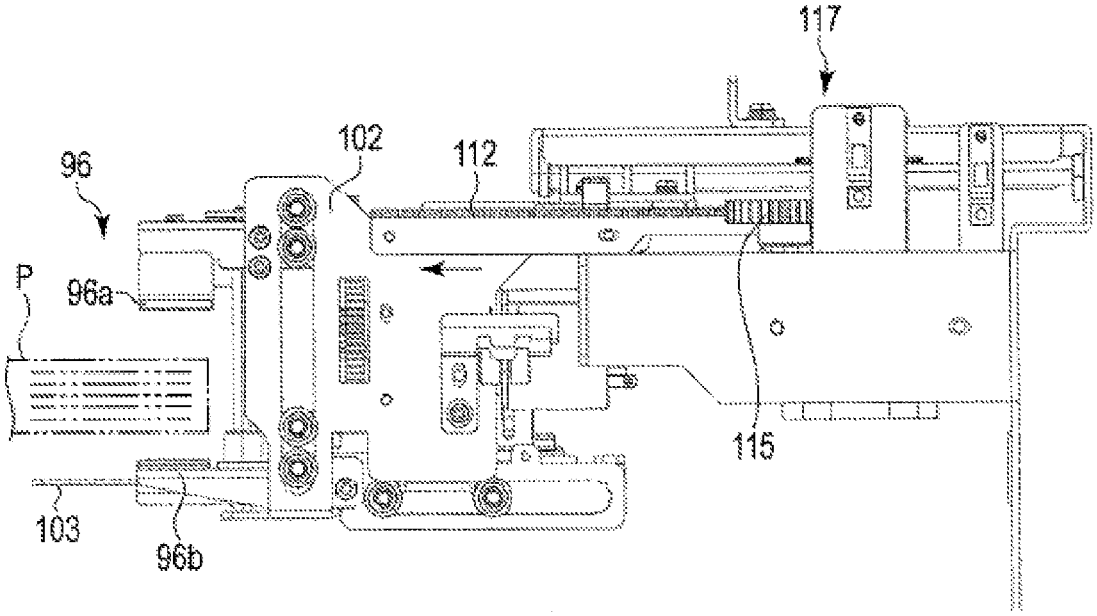
FIG. 20 is a front view showing the hand assembly and hand drive mechanism in an advanced position.
Figure 21:
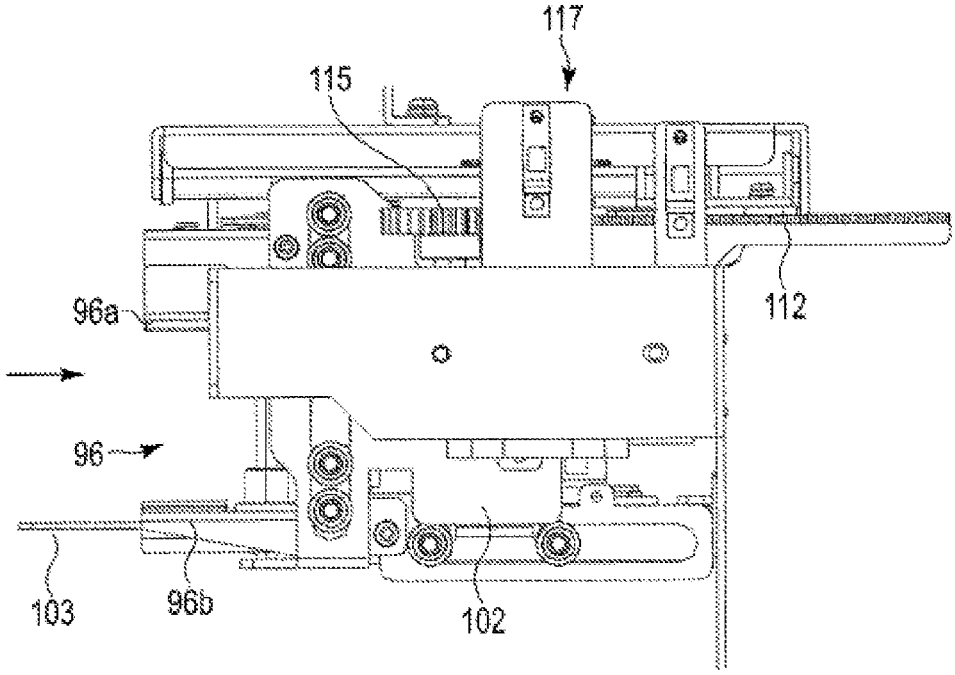
FIG. 21 is a front view showing the hand assembly and hand drive mechanism in a drawn-in position.

As the second motor 114 is rotated in one direction, as shown in FIG. 20, the rack 112 and support frame, 102 are driven to move the upper and lower hands 96*a* and 96*b* to their advanced position where they grasp the stacked bill bundle P. As the second motor 114 is rotated in the other direction, as shown in FIG. 21, in contrast, the rack 112 and support frame 102 are driven to move the upper and lower hands 96*a* and 96*b* to their retracted position where they draw the grasped stacked bill bundle P into the binding position.

Figure 22:
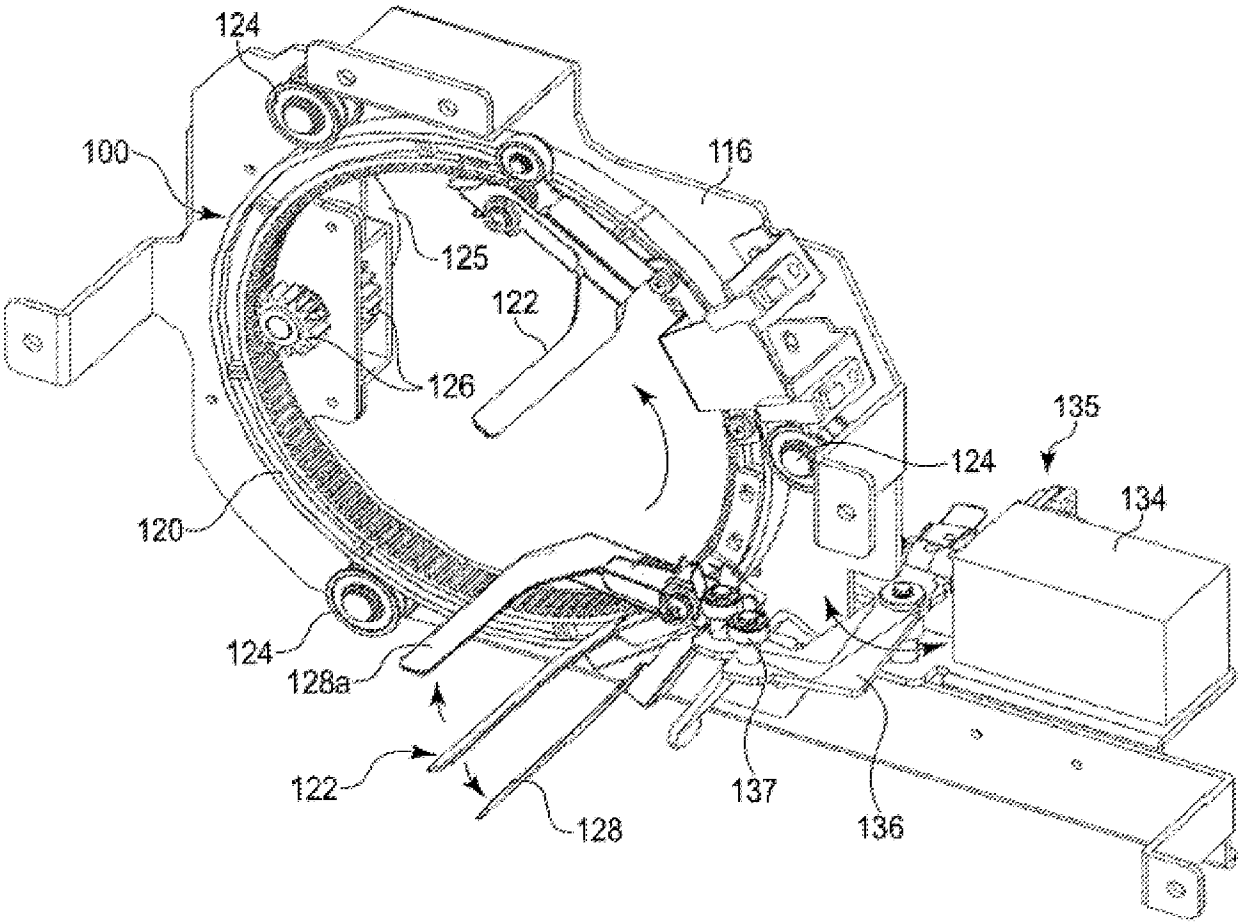
FIG. 22 is a perspective view showing a ring gear, band catcher, and opening/closing mechanism of the band winding device.
Figure 23:
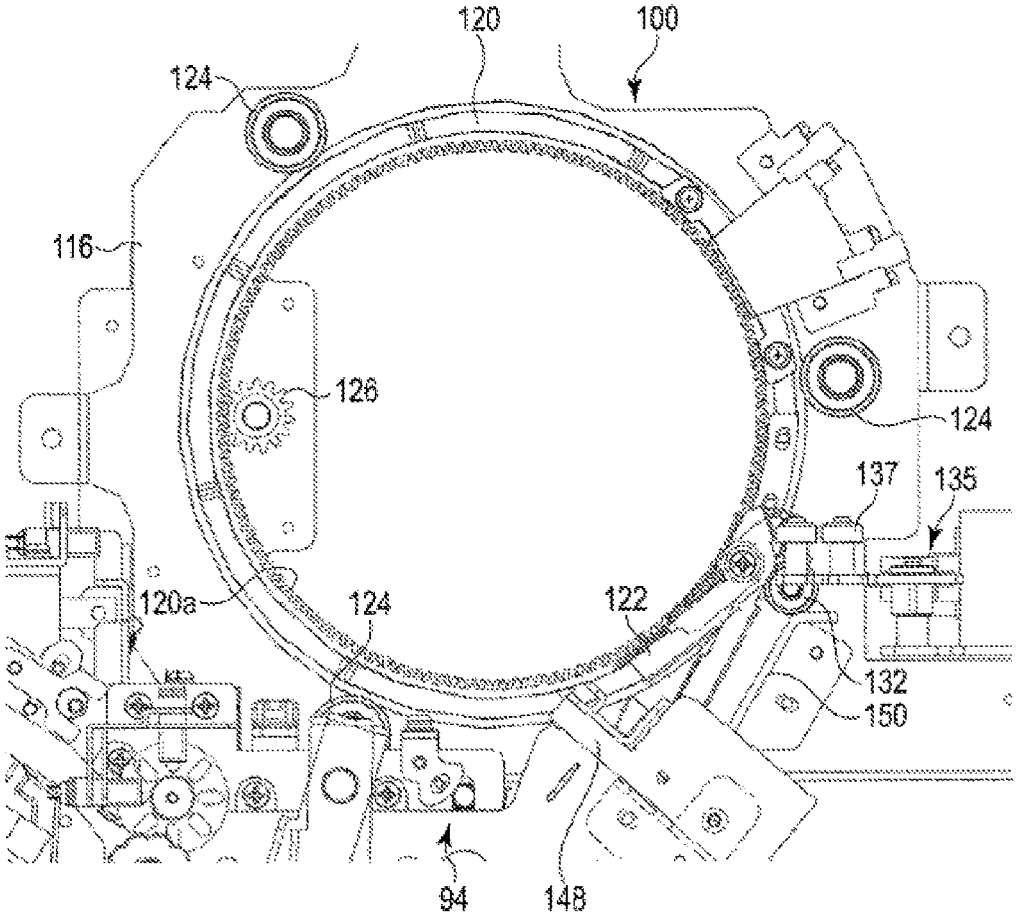
FIG. 23 is a front view showing the ring gear, band catcher, opening/closing mechanism, and band feed mechanism of the band winding device.
Figure 24:
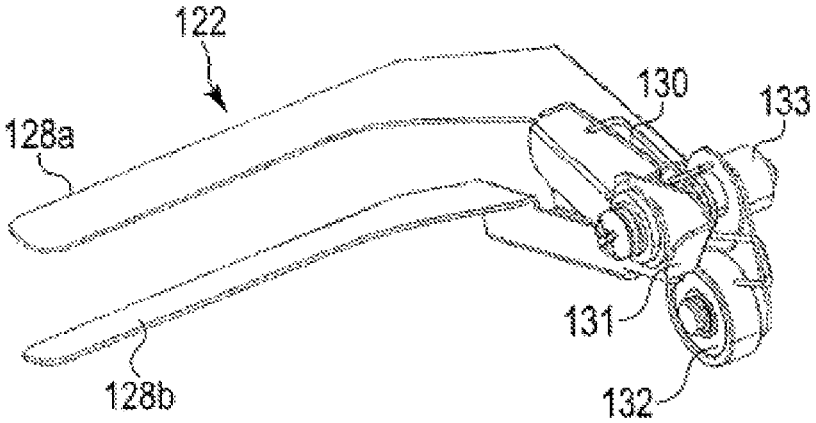
FIG. 24 is a perspective view showing the band catcher in its open position.
Figure 25:
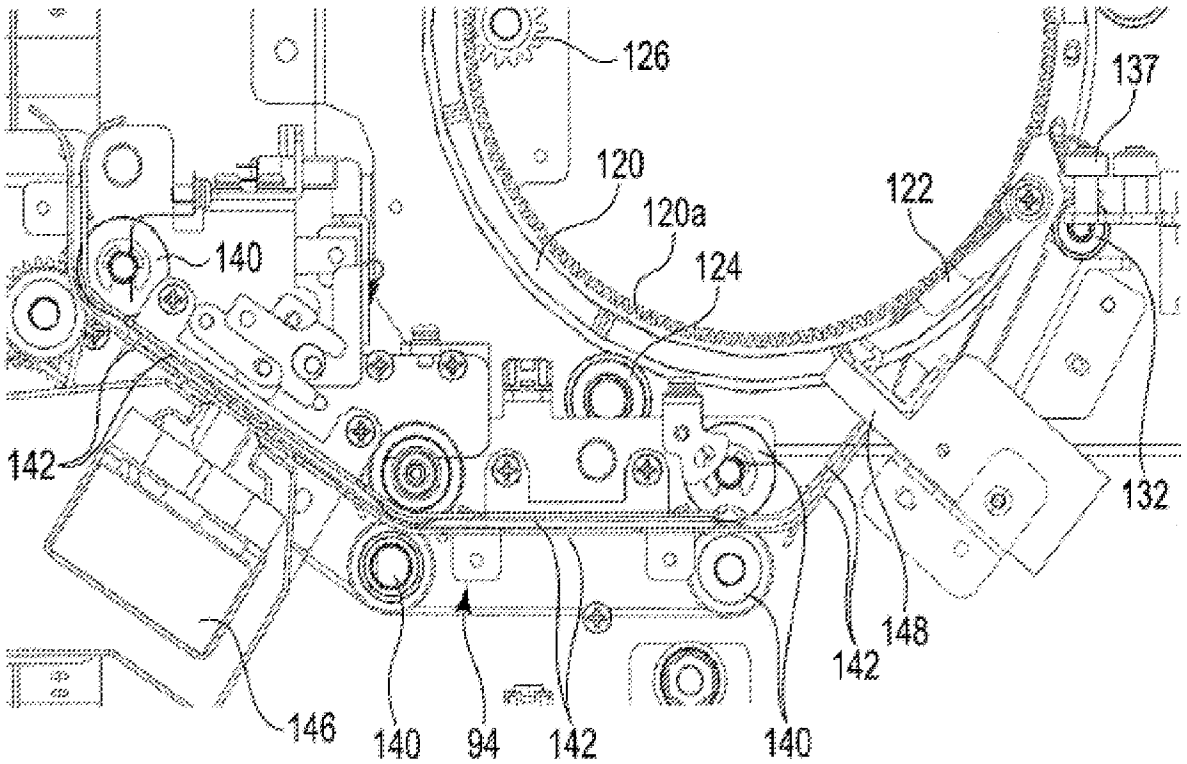
FIG. 25 is a front view, partially in section, showing the ring gear, band catcher, and band feed mechanism.
Figure 26:
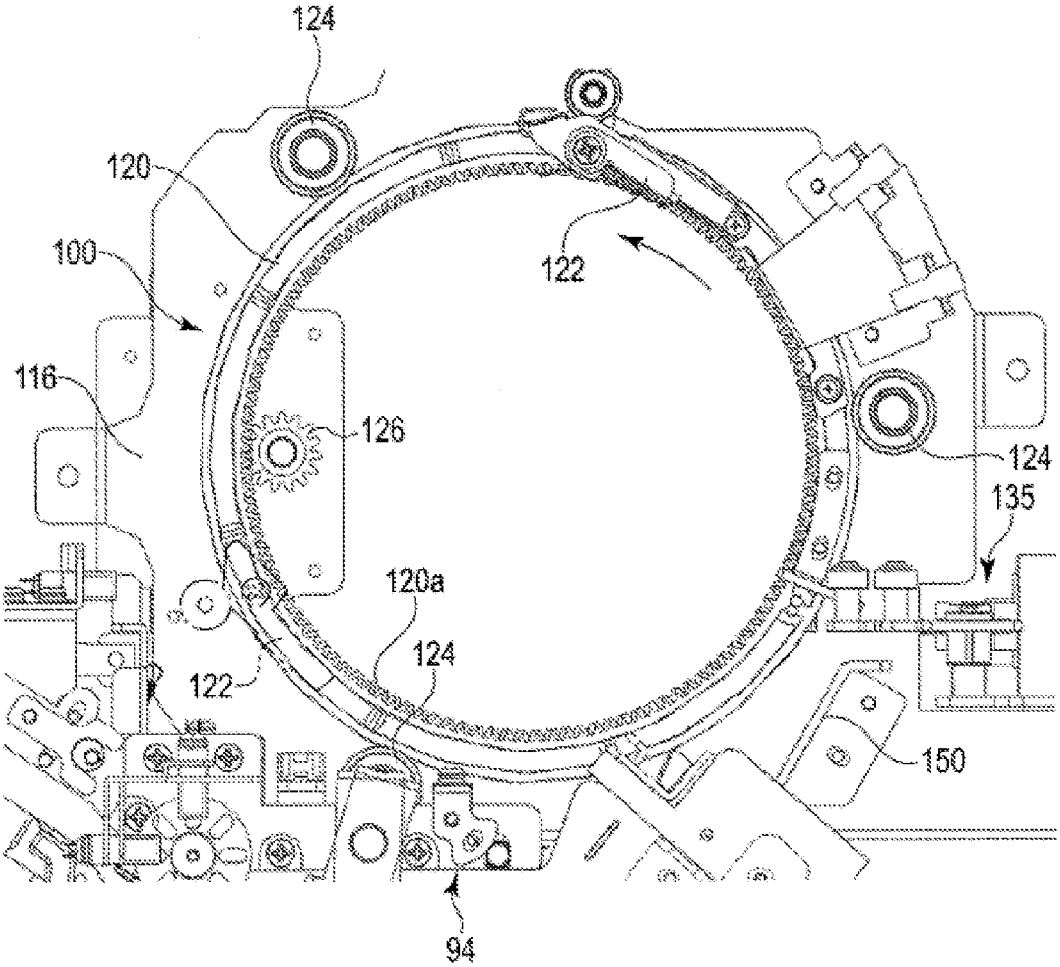
FIG. 26 is a front view showing the ring gear, band catcher, opening/closing mechanism, and band feed mechanism.

FIGS. 24 to 26 show the band winding device 100, which winds the wrapper band around the stacked bill bundle P drawn into the binding position, and the band feed mechanism 94 of the band feeder 90. As shown in FIGS. 14, 22, and 23, the band winding device 100 comprises a ring gear 120, band catcher 122, and band drive mechanism. The ring gear 120 is supported on an annular support frame 116, and the band catcher 122 is mounted on the ring gear. The band drive mechanism rotates the ring gear 120 and delivers the wrapper band 91 from the band feeder 90 with the leading end of the wrapper band clamped by the band catcher, thereby forming a looped wrapper band along the ring gear in the binding position.

The ring gear 120 has its outer peripheral surface supported by a plurality (e.g., three) of guide pulleys 124, which are rotatably mounted on the support frame 116. Thus, the ring gear 120 is supported on the support frame 116 for rotation about a horizontal axis, that is, an axis parallel to the direction of reciprocation of the hand assembly 96. Further, the ring gear 120 is located so as to externally cover the hand assembly 96 with a gap therebetween. Thus, the hand assembly 96 is movable inside the ring gear 120.

A gear 120*a* is formed on the inner peripheral surface of the ring gear 120. The band drive mechanism comprises a third motor 125 mounted on the support frame 116, and a gear train 126 meshes between the gear 120*a* and the rotating shaft of the third motor 125. As the third motor 125 is driven, the ring gear 120 is rotated in a predetermined direction, e.g., counterclockwise, about a horizontal axis.

The band catcher 122 is mounted on the ring gear 120 so that it can rotate together with the ring gear 120 about the horizontal axis. As shown in FIGS. 22 to 24, the band catcher 122 comprises a pair of catch arms 128*a* and 128*b*. These catch arms 128*a* and 128*b* extend forward from the ring gear 120 in parallel relation to the horizontal axis. Further, they are supported by the ring gear 120 for pivotal motion about a pivot 133 between a closed position shown in FIGS. 22 and 23 and an open position shown in FIG. 24. In the closed position, the arms 128*a* and 128*b* contact each other to clamp the wrapper band. In the open position, they are spaced apart from each other to release the wrapper band. The catch arms 128*a* and 128*b* are urged toward the closed position. A press lug 131 protrudes from the proximal end portion of the catch arm 128*a*, while a guide roller 132 is rotatably mounted on the proximal end portion of the catch arm 128*b*.

As shown in FIGS. 22 and 23, the support frame 116 is provided with an opening mechanism 135 that opens the band catcher 122 to the open position. The opening mechanism 135 comprises a plunger 134, push arm 136, and pressure roller 137. The push arm 136 is pivotable by the plunger. The pressure roller 137 is mounted on the distal end of the push arm 136 and presses the press lug 131 of the catch arm 128*a*. In winding the wrapper band 91, the band catcher 122 is kept on standby in a clamping position (e.g., corresponding to the 5-o'clock position of the hour hand) shown in FIGS. 22 and 23. As the push arm 136 is pivoted by the plunger 134 of the opening mechanism 135, moreover, the band catcher 122 is kept on standby in the open position where the wrapper band 91 is allowed to pass.

As shown in FIGS. 23 and 25, the band feed mechanism 94 of the band feeder 90 comprises a plurality of guides 142 arranged along the transport path, a plurality of transport rollers 140, and a fourth motor 144 for driving the transport rollers. The band feed mechanism 94 transports the wrapper band 91 interposed between the transport rollers 140, draws it out from the band reel 92, and delivers the wrapper band to the band catcher 122 kept on standby in its initial position. A printer 146 is disposed in the middle of the transport path, and it prints desired print information on the wrapper band 91. A cutter 148 is disposed between an end of the transport path for the wrapper band 91 and the band catcher 122. The wrapper band 91 is delivered to the band catcher 122 through the edge of the cutter 148.

In the band winding device 100 and band feed mechanism 94 constructed in this manner, as shown in FIGS. 22 and 25, the wrapper band 91 is drawn out of the band reel 92 by the band feed mechanism 94 with the band catcher 122 kept on standby in the clamping position and with the catch arms 128*a* and 128*b* opened by the opening mechanism 135. Then, the leading end of the wrapper band is delivered to the space between the catch arms of the band catcher 122 through the cutter 148. Thereafter, a press by the opening mechanism 135 is released, and the leading end of the wrapper band 91 is clamped by the band catcher 122. Subsequently, as shown in FIG. 26, the wrapper band 91 is delivered by the band feed mechanism 94 as the ring gear 120 is rotated counterclockwise through a predetermined angle, whereby the band catcher 122 is moved to a standby position indicated by a two-dot chain line in the figure. Thereupon, the wrapper band 91 is drawn out in a loop along the ring gear 120 and located around the binding position. In this state, the bill bundle P is grasped by the hand assembly 96 and drawn into the looped wrapper band 91. In the standby position, the band catcher 122 and looped wrapper band 91 are located off a draw-in path for the stacked bill bundle P and kept from hindering the draw-in operation.

While the stacked bill bundle P is being transported from the stacking devices 64*a* and 64*b* to the wrapping device 68 by the transport carrier, the band winding device 100 and band feed mechanism 94 previously form the looped wrapper band 91 in the binding position. The time required for the winding operation can be reduced by thus previously setting the wrapper band 91.

Figure 27:
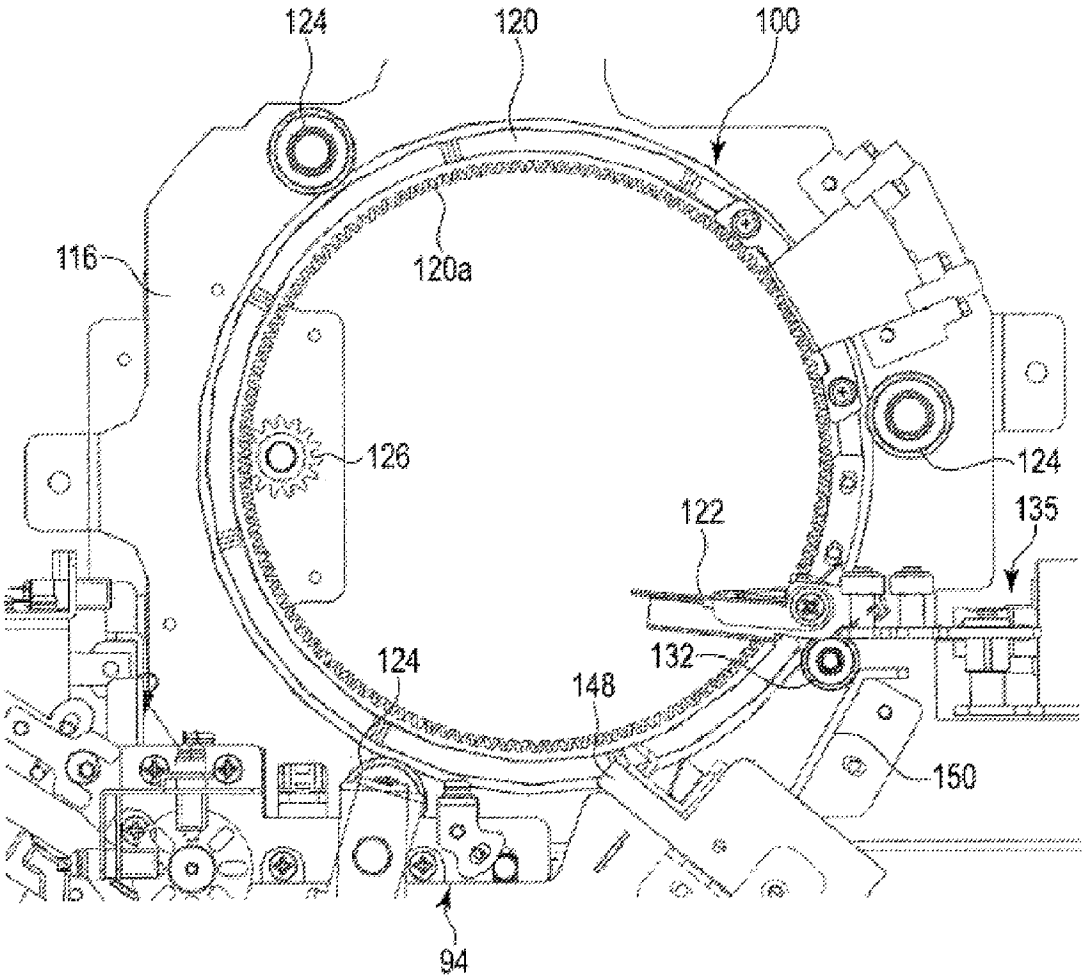
FIG. 27 is a front view showing the ring gear, band catcher in a horizontal position, and band feed mechanism.

After the stacked bill bundle P is drawn into the binding position, as shown in FIG. 27, the ring gear 120 is further rotated counterclockwise, whereupon the band catcher 122 is moved to the vicinity of the clamping position. The guide roller 132 of the band catcher 122 abuts a guide plate 150 on the support frame 116, whereupon the band catcher 122 is pivoted to a substantially horizontal position. In this way, the leading end of the wrapper band 91 clamped by the band catcher 122 gets in below the bill bundle P and is held there. The looped wrapper band 91 is located around the binding position for the stacked bill bundle P and in a position where it covers the support plate 103 on the hand assembly 96. Thus, the position of the band catcher 122 can be regulated by only rotating the ring gear 120.

In this state, the wrapper band 91 is pulled back a certain distance by the band feed mechanism 94 such that the size of its loop is reduced, whereby the wrapper band is loosely wound around the bill bundle P and support plate 103.

As shown in FIGS. 14 and 15, the band winding device 100 comprises a first band retainer 152, upper clamper 160, first clamper drive mechanism 162, second band retainer 170, heater 180, and second clamper drive mechanism 190. The first band retainer 152 presses the wrapper band 91 against the support plate 103 of the hand assembly 96, thereby preventing dislocation of the band. The upper clamper 160 presses the wrapper band 91 and stacked bill bundle P from above in the binding position and depresses the opposite longitudinal side portions of the bill bundle toward the support plate 103, thereby curving the entire bill bundle. The first clamper drive mechanism 162 causes the upper clamper 160 to ascend and descend synchronously with the first band retainer 152. The second band retainer 170 presses and holds the tightened wrapper band 91 against the stacked bill bundle P. The heater 180 heats and seals a seam of the pressed wrapper band 91. The second clamper drive mechanism 190 moves the second band retainer 170 and heater 180 in association with each other to a position where they abut the wrapper band 91.

Figure 28:
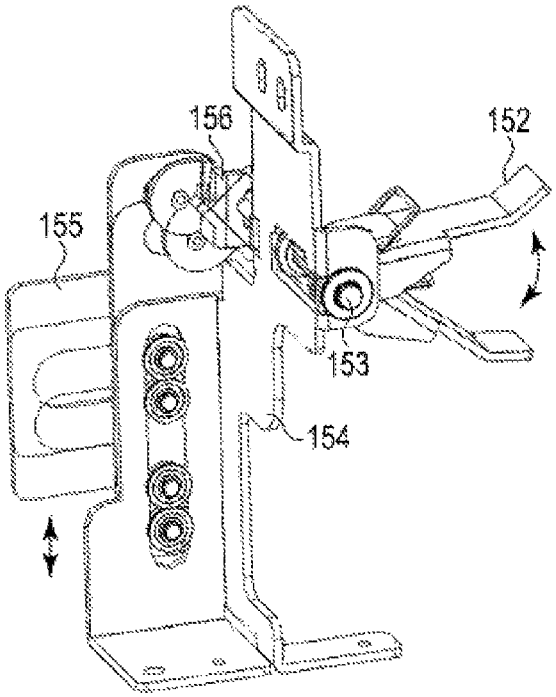
FIG. 28 is a perspective view showing a first band retainer of the band winding device.
Figure 29:
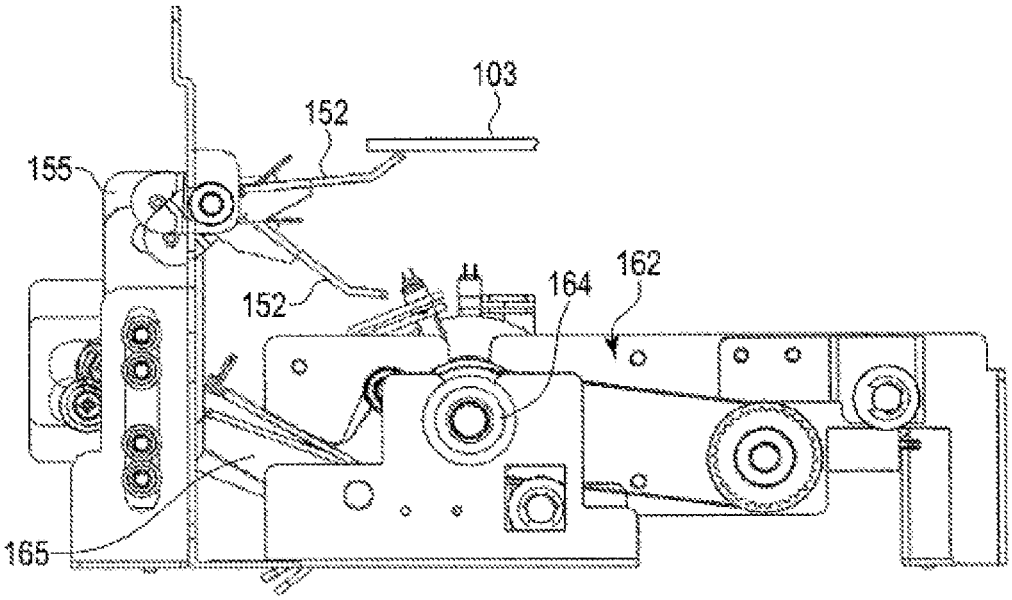
FIG. 29 is a side view showing the first band retainer and a first clamper drive mechanism.

FIGS. 28 and 29 show the first band retainer 152 and first clamper drive mechanism 162. As seen from these figures, the first band retainer 152 is a plate-like arm with a bent distal end portion, the proximal end portion of which is supported by a support frame 154 for pivotal motion about a horizontal pivot 153. A drive plate 155 is mounted on the support frame 154 for vertical up-and-down motion, and it is connected to the pivot 153 of the first band retainer 152 through a swing arm 156. As the drive plate 155 is raised or lowered by the first clamper drive mechanism 162, the first band retainer 152 is pivoted between a standby position where it is located off the transport paths for the wrapper band 91 and stacked bill bundle P and a retaining position where it abuts the lower surface of the support plate 103 of the hand assembly 96 and presses the wrapper band 91 against the support plate (ironing board) 103.

The surface of the first band retainer 152 consists mainly of, for example, hardened iron. Thus, the first band retainer 152 has a surface hardness higher than that of the support plate 103 that abuts it. The first band retainer 152 holds down the wrapper band with its sheet-metal edge. Since the surface hardness of the receiving support plate 103 is made lower than that of the sheet metal of the pressing edge, frictional force can be produced by scratching the lower surface of the support plate 103 so that the wrapper band 91 can be gripped without slipping.

As described later, the first clamper drive mechanism 162 comprises a drive motor 163 supported on a support frame, drive pulley 164 rotatable by the drive motor through a helical gear, and drive arm 165 pivotable by the drive pulley. The drive arm 165 is connected to the drive plate 155 through rollers. Thus, as the drive motor 163 is driven, the drive plate 155 is raised or lowered by the drive arm 165, and the first band retainer 152 is pivoted by the drive plate 155.

Figure 30:
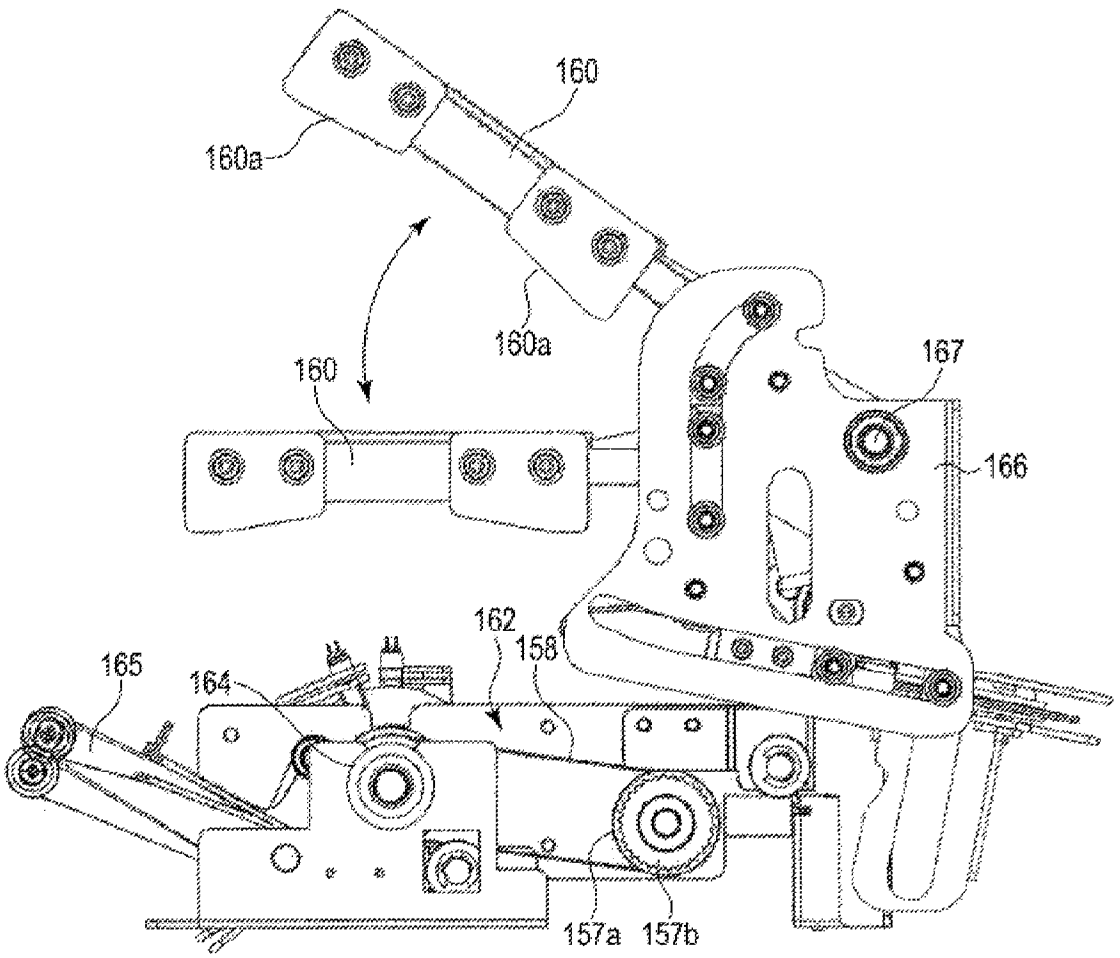
FIG. 30 is a front view showing the upper clamper and first clamper drive mechanism of the band winding device.
Figure 31:
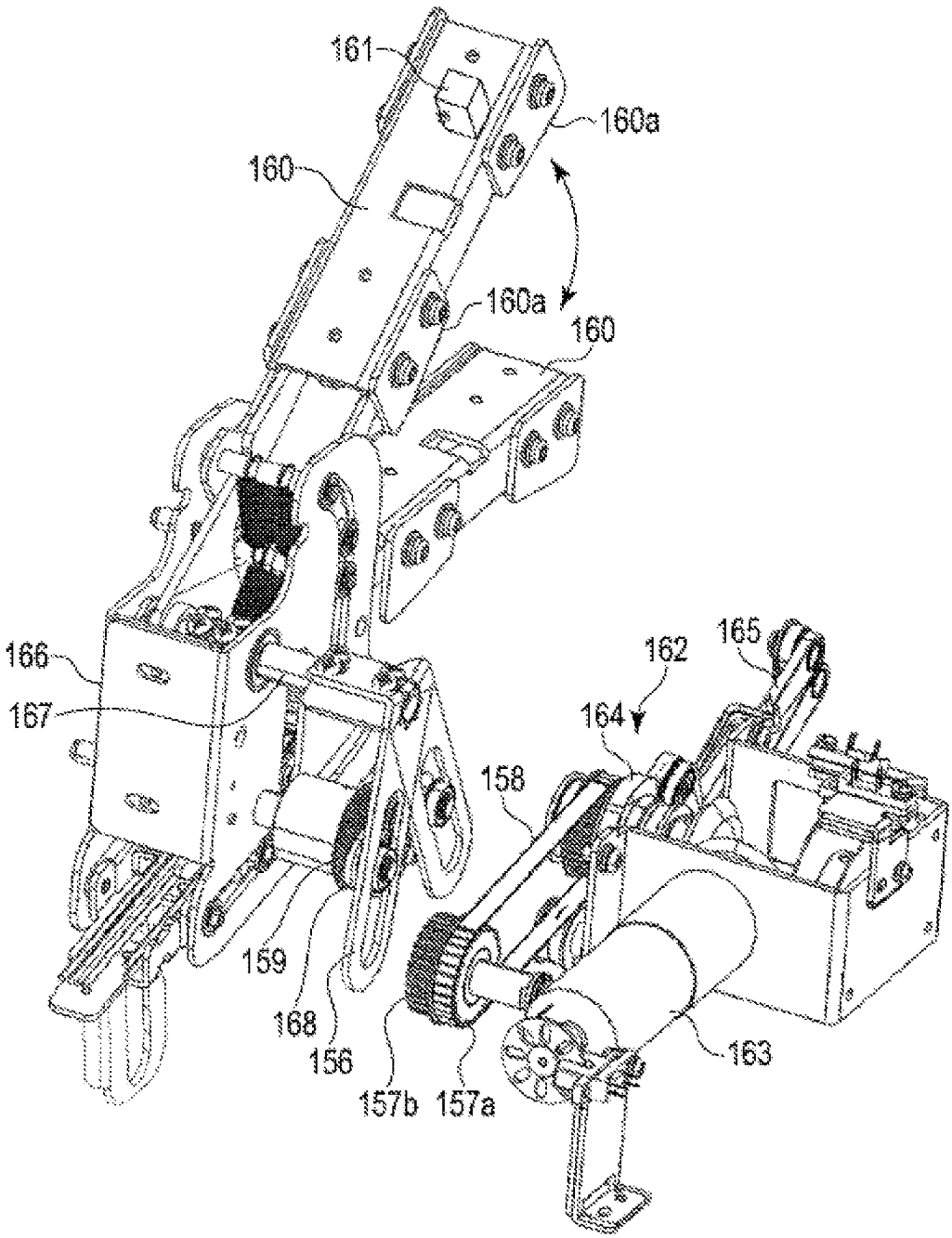
FIG. 31 is a perspective view showing the upper clamper and first clamper drive mechanism.

FIGS. 30 and 31 show the upper clamper 160 and first clamper drive mechanism 162. As seen from these figures, the upper clamper 160 is an elongated arm comprising press sections 160*a* configured to press the upper surface side of the stacked bill bundle P. The press sections 160*a* are laterally inclined so that the entire stacked bill bundle P pressed thereby from above is curved such that its central portion is higher than its opposite side portions.

The proximal end portion of the upper clamper 160 is pivotably supported on a support frame 166 by a pivot 167. The swing arm 156 is mounted on one end of the pivot 167. The first clamper drive mechanism 162 comprises a driven pulley 157*a*, drive gear 157*b*, drive belt 158, driven gear 159, and rotating plate 168. The driven pulley 157*a* is supported for rotation, and the drive gear 157*b* is formed integrally with the driven pulley. The drive belt 158 spans between the drive and driven pulleys. The driven gear 159 is rotatably supported on the side of the support frame 166 and meshes with the drive gear 157*b*. The rotating plate 168 is attached to the driven gear and engages with a guide slit of the swing arm 156 by means of a roller.

As the drive pulley 164 is rotated by the drive motor 163, the drive belt 158, driven pulley 157*a*, drive gear 157*b*, and driven gear 159 rotate. The rotating plate 168 rotates integrally with the driven gear 159 to pivot the swing arm 156 through the roller, thereby pivoting the upper clamper 160 by means of the pivot 167. In this way, as shown in FIGS. 30 and 31, the upper clamper 160 is pivoted between an up position where it is located off the transport paths for the stacked bill bundle P and wrapper band 91 and a down-press position where it presses the stacked bill bundle P grasped by the hand assembly 96 and the wrapper band 91 from above. A press member 161, e.g., a roller or arcuate member, is disposed on the inner surface side of the upper clamper 160. The press member 161 serves to prevent slackening in the down-press position of the upper clamper by pressing the wrapper band 91 wound around the stacked bill bundle P against the bill bundle.

As the drive motor 163 of the first clamper drive mechanism 162 is rotated in the manner described above, moreover, the first band retainer 152 and upper clamper 160 are driven synchronously. In winding the wrapper band 91, for example, the first band retainer 152 is pivoted from the standby position to the retaining position by the first clamper drive mechanism 162. In synchronism with this, the upper clamper 160 is pivoted from the up position to the down-press position.

The wrapper band 91 is pressed against the support plate 103 by the first band retainer 152, and the stacked bill bundle P and the wrapper band are pressed by the upper clamper 160 from above so that the opposite side portions of the bill bundle P are curved downward. In this state, as described later, the wrapper band 91 is further pulled back a certain distance by the band feed mechanism 94 to tighten the wrapper band wound around the bill bundle P.

Figure 32:
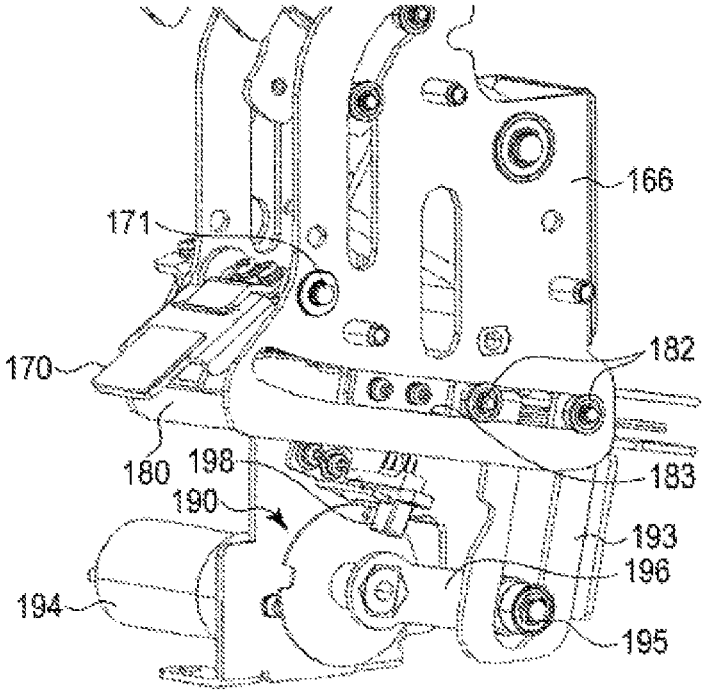
FIG. 32 is a perspective view showing a second band retainer, heater, and second clamper drive mechanism of the band winding device.
Figure 33:
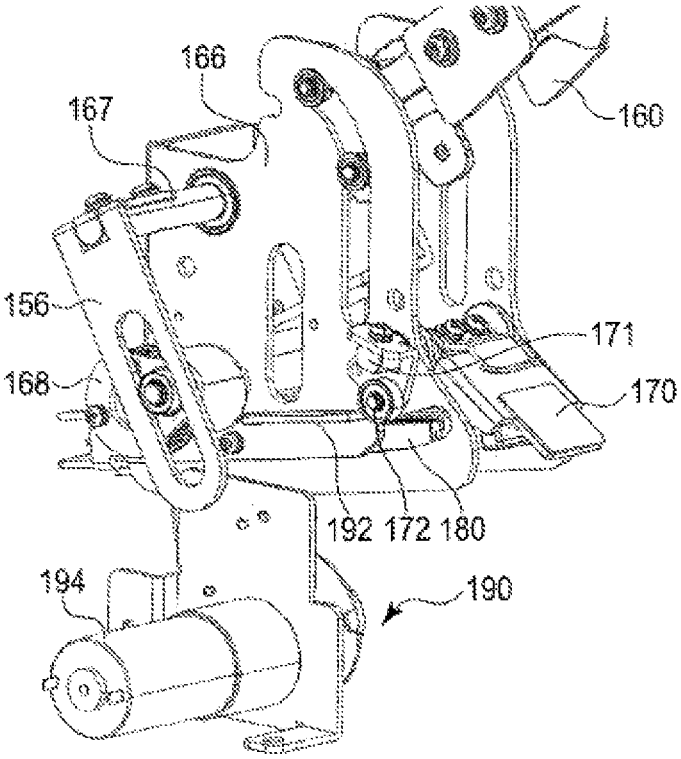
FIG. 33 is a perspective view showing the second band retainer, heater, and second clamper drive mechanism in their respective standby positions.
Figure 34:
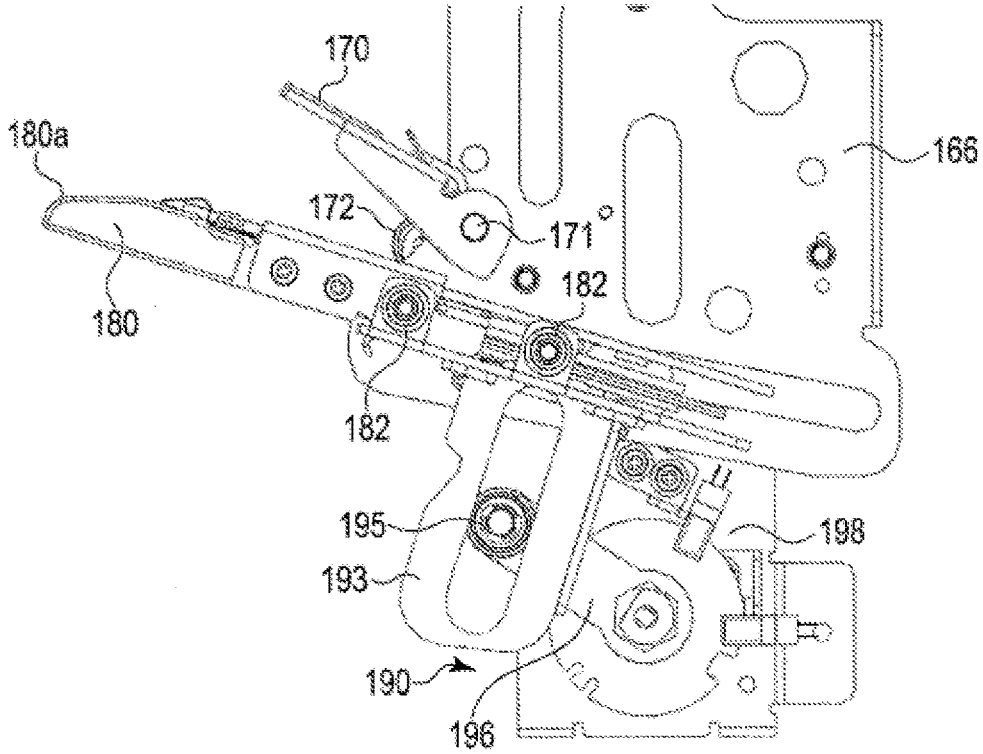
FIG. 34 is a side view showing the second band retainer in the retaining position, the heater in the heat-sealing position, and the second clamper drive mechanism.
Figure 42:
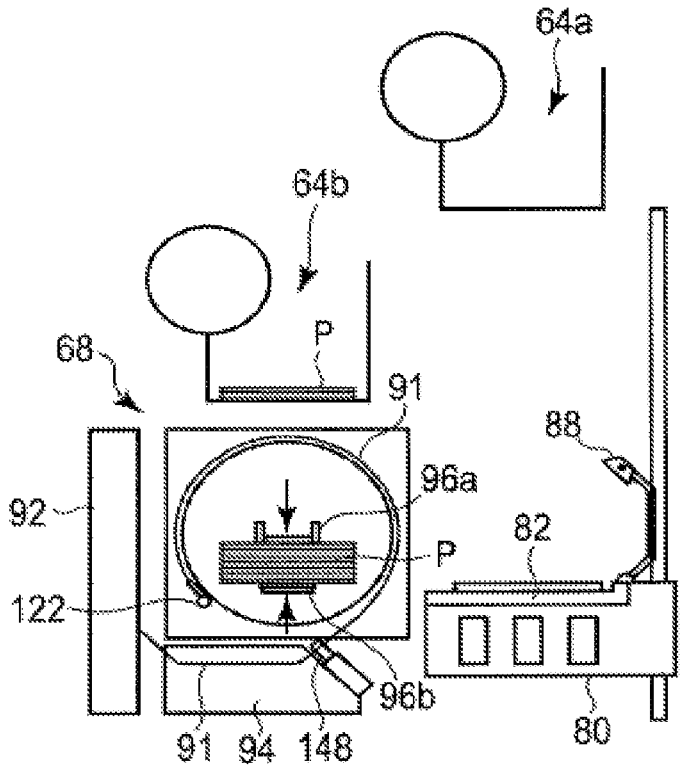
FIG. 42 is a side view of the stacking/wrapping apparatus schematically illustrating the stacking and wrapping operations.
Figure 43:
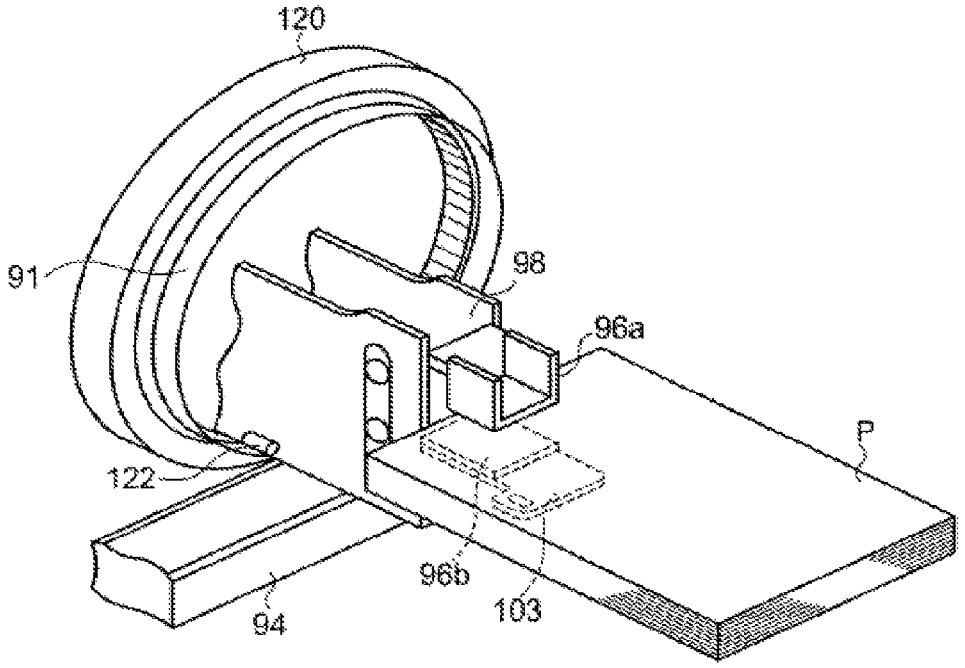
FIG. 43 is a perspective view showing how the bill bundle is received by the hand assembly.

FIGS. 32, 33, and 34 show the second band retainer 170, heater 180, and second clamper drive mechanism 190. As seen from these figures, the second band retainer 170 is a substantially flat plate-like arm, the proximal end portion of which is supported by the support frame 166 for pivotal motion about a horizontal pivot 171. A guide roller 172 is rotatably mounted on the proximal end portion of the second band retainer 170 in a position eccentric to the pivot 171. The second band retainer 170 is pivoted by the second clamper drive mechanism 190 between a standby position where it is located off the transport paths for the wrapper band 91 and stacked bill bundle P, as shown in FIGS. 32 and 33, and a retaining position where it abuts a corner portion of the lower surface of the stacked bill bundle P and presses and holds the wrapper band 91 against the bill bundle P, as shown in FIGS. 42 and 43.

As shown in FIGS. 32 to 34, the heater 180 is an elongated bar, the distal end portion of which constitutes a heating section 180*a*. The heater 180 is supported for linear reciprocation by the support frame 166. Guide rollers 182, e.g., two in number, are rotatably mounted on each side surface of the heater 180, and they are slidably supported in a guide slit 183 formed in the support frame 166. Thus, the heater 180 can reciprocate between a standby position where it is located off the transport paths for the wrapper band 91 and stacked bill bundle P, as shown in FIGS. 32 and 33, and a heat-sealing position where it presses the wrapper band 91 against the lower surface of the support plate (ironing board) 103 to heat-seal the wrapper band, as shown in FIG. 34.

The second clamper drive mechanism 190, which drives the second band retainer 170 and heater 180 in association with each other, comprises a guide plate 192, drive bracket 193, fourth motor 194, pivoting arm 196, and sensor 198. The guide plate 192 is mounted on the upper surface of the heater 180 and can engage with the guide roller 172 of the second band retainer 170. The drive bracket 193 extends substantially vertically from the lower surface of the heater 180 and comprises a guide slit. The fourth motor 194 is mounted on the support frame 166. One end of the pivoting arm 196 is connected to the rotating shaft of the drive motor, and a guide roller 195 is rotatably mounted on the other end of the arm. The sensor 198 is configured to detect the amount of pivotal movement of the pivoting arm 196. The guide roller 195 is in engagement with the guide slit of the drive bracket 193.

As the fourth motor 194 is rotated in one direction, the pivoting arm 196 pivots so that the drive bracket 193 is moved integrally with the heater 180 toward the heat-sealing position by the pivoting arm. Immediately after the start of the movement of the heater 180, moreover, the guide plate 192 pushes up the guide roller 172 of the second band retainer 170, thereby pivoting the second band retainer 170 from the standby position to the retaining position.

As the fourth motor 194 is rotated in the other direction, the heater 180 is moved from the heat-sealing position to the standby position. Thereupon, the guide plate 192 leaves the guide roller 172 of the second band retainer 170 and is pivoted from the retaining position to the standby position by the urging force of a spring or the like.

Figure 35:
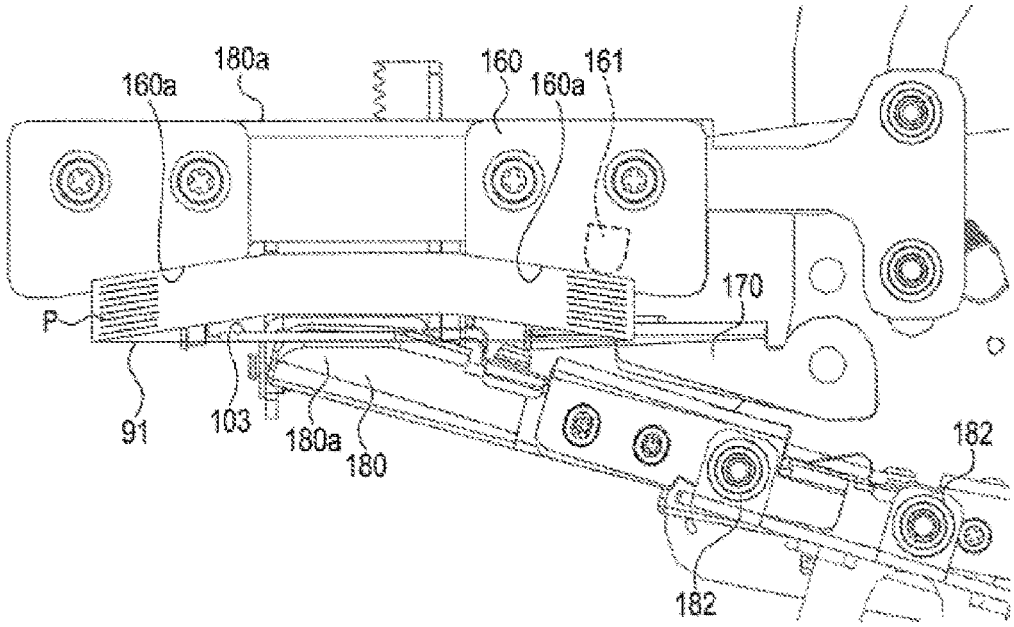
FIG. 35 is a front view showing the upper clamper, the second band retainer in the retaining position, the heater in the heat-sealing position, and a bill bundle.

As shown in FIG. 35, the second band retainer 170 pivoted to the retaining position presses and holds the wrapper band 91 against the lower right corner of the stacked bill bundle P with the upper clamper 160 pivoted to the press position. The press member 161 on the upper clamper 160 is located opposite the second band retainer 170 with the bill bundle P therebetween and presses and holds the wrapper band 91 against the upper surface of the bill bundle P. In this way, the wrapper band 91 can be prevented from slackening as it is cut. The press member 161 presses the wrapper band 91 from above in such a manner that it is not very resistive when it tightens the wrapper band and that it becomes more resistive when the wrapper band is cut and naturally slackens.

After the trailing end side of the wrapper band 91 is then cut by the cutter 148, the heater 180 is moved from the standby position to the heat-sealing position. As this is done, the trailing end portion of the wrapper band 91 is pushed up to the position of the support plate 103 by the heater 180 and pressed against the wound wrapper band in an overlapping manner. In this state, the overlapping portion of the wrapper band 91 is heat-sealed by the heater 180. After the wrapper band 91 is heat-sealed, the first band retainer 152, upper clamper 160, second band retainer 170, and heater 180 are returned to their respective standby or up positions and kept apart from the stacked bill bundle P.

Figure 36A:
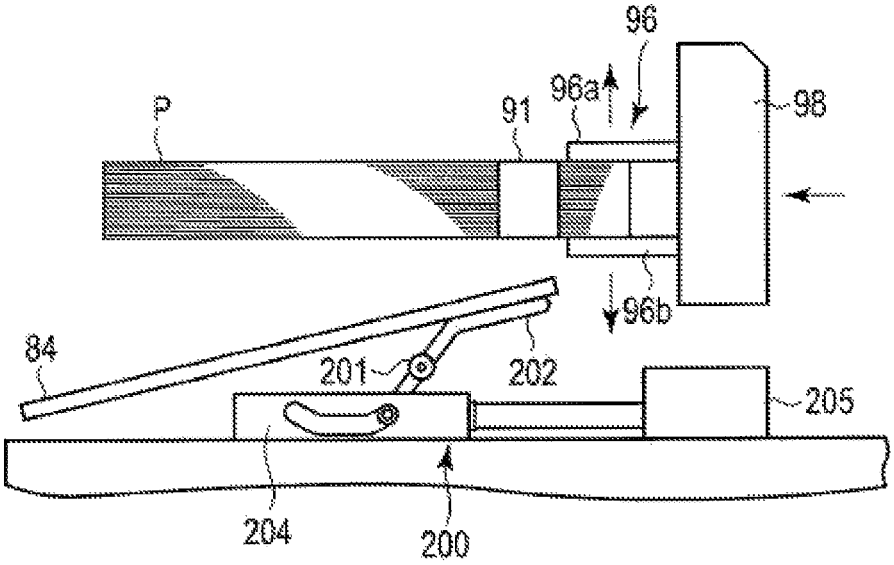
FIGS. 36A, 36B, 36C are side views showing the hand assembly, the release block, and a discharge mechanism.
Figure 36B:
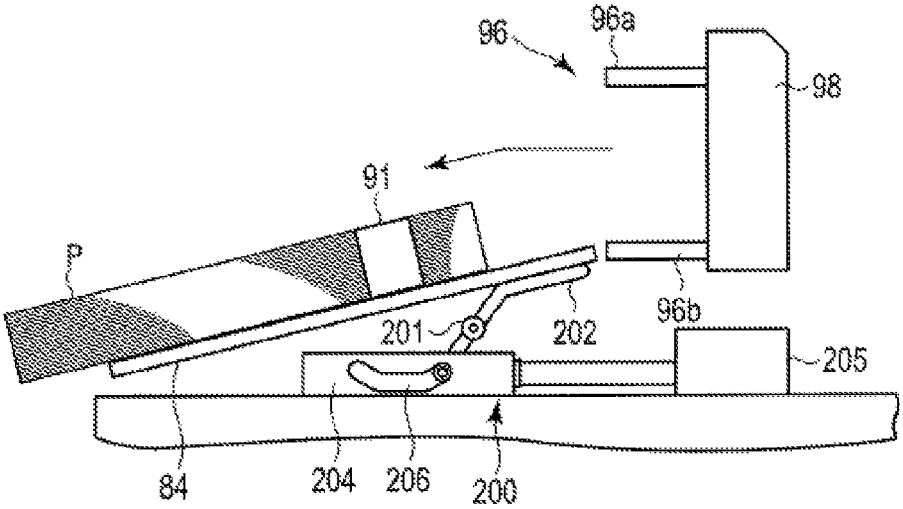
Figure 36C:
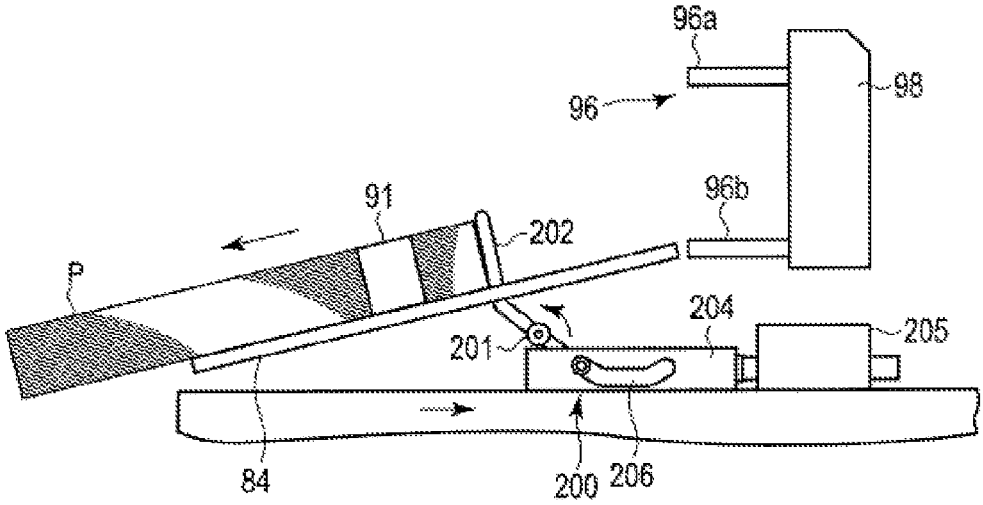

As shown in FIGS. 36A, 36B, and 36C, the wrapping device comprises a discharge mechanism 200, which discharges the bound stacked bill bundle P to be thrown out onto the release block 84 to the outside of the apparatus. The discharge mechanism 200 comprises an ejector lever 202, sliding plate 204, and a drive source, e.g., a plunger 205. The ejector lever 202 is located below the release block 84 for pivotal motion about a pivot 201. The sliding plate 204 is disposed below the release block for substantially horizontal reciprocation. The plunger 205 serves to drive the sliding plate. A guide roller is rotatably mounted on the lower end of the ejector lever 202, and it engages with a guide slot 206 in the sliding plate 204. The ejector lever 202 is pivotable between a standby position where it is located below the release block 84, as shown in FIG. 36A, and a press position where it pushes out the bill bundle P on the release block 84 forward, as shown in FIG. 36C. As the sliding plate 204 is moved from its advanced position to its retracted position by the plunger 205, the ejector lever 202 is pivoted from the standby position to the press position through a guide roller.

When the wrapping of the stacked bill bundle P with the wrapper band 91 is finished, the hand assembly 96 grasping the stacked bill bundle P is moved forward, that is, toward the release block 84, from a drawn-in position at a predetermined speed by the hand drive mechanism 98, as shown in FIG. 36A. When the hand assembly 96 is advanced to a predetermined position, as shown in FIG. 36B, moreover, it is opened (or released) so that the hold on the bill bundle P is released. Thereupon, the bill bundle P is thrown out onto the release block 84. The throwing speed is set to such a value that the end surface of the bill bundle P neither remains in the hand assembly 96 nor collides with the cover of the stacking/wrapping apparatus.

Then, as shown in FIG. 36C, the ejector lever 202 is pivoted from the standby position to the press position by the discharge mechanism 200, whereupon the trailing end of the stacked bill bundle P on the release block 84 is pressed by the ejector lever 202. Thus, the stacked bill bundle P on the release block is discharged to the outside of the apparatus.

Figure 37:
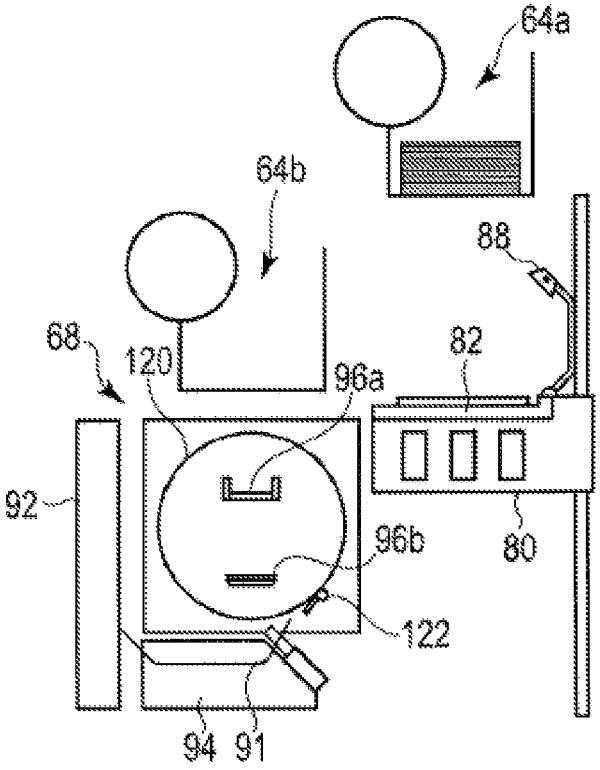
FIG. 37 is a side view of the stacking/wrapping apparatus schematically illustrating stacking and wrapping operations.

A stacking operation of the stacking/wrapping module 60 constructed in this manner and a wrapping operation with the wrapper band will now be described with reference to FIGS. 37 to 56. As shown in FIG. 37, for example, a predetermined number (e.g., 100) of bills of the same denomination are stacked by the first stacking device 64*a*. When this is done, the base carrier 80 of the transport carrier is kept on standby in the first position such that the sheet carrier 82 thereon is adjacently opposed to the first shutter 67 from below.

While the bills are being stacked, the band catcher 122 of the wrapping device 68 is kept on standby in the clamping position (e.g., corresponding to the 5-o'clock position of the hour hand) and in the open position where the wrapper band is allowed to pass.

Figure 38:
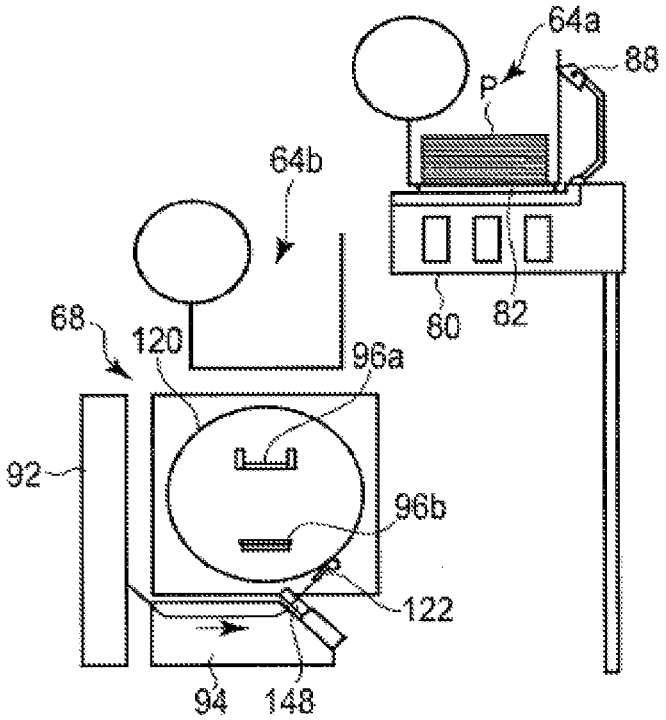
FIG. 38 is a side view of the stacking/wrapping apparatus schematically illustrating the stacking and wrapping operations.

While the predetermined number of bills are being stacked, as shown in FIG. 38, the wrapping device 68 delivers the wrapper band 91 by means of the band feed mechanism 94 of the band feeder and feeds it to the band catcher 122 through the cutter 148. Then, the band catcher 122 grasps the leading end of the fed wrapper band.

Figure 39:
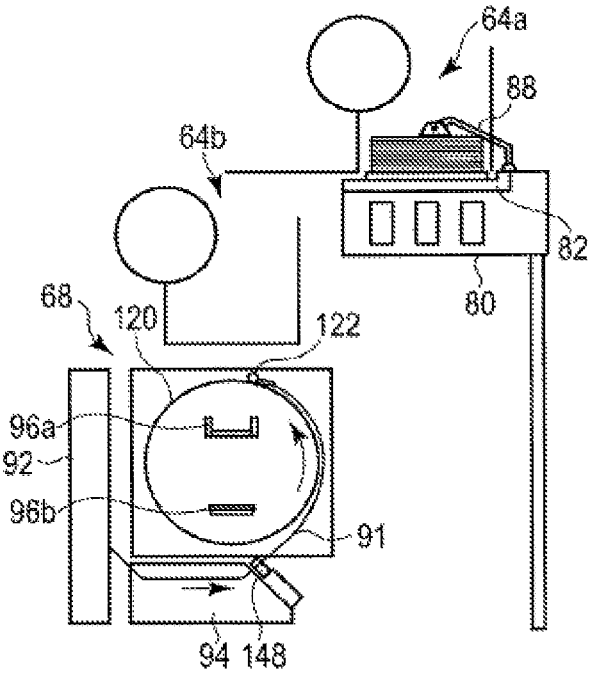
FIG. 39 is a side view of the stacking/wrapping apparatus schematically illustrating the stacking and wrapping operations.
Figure 40:
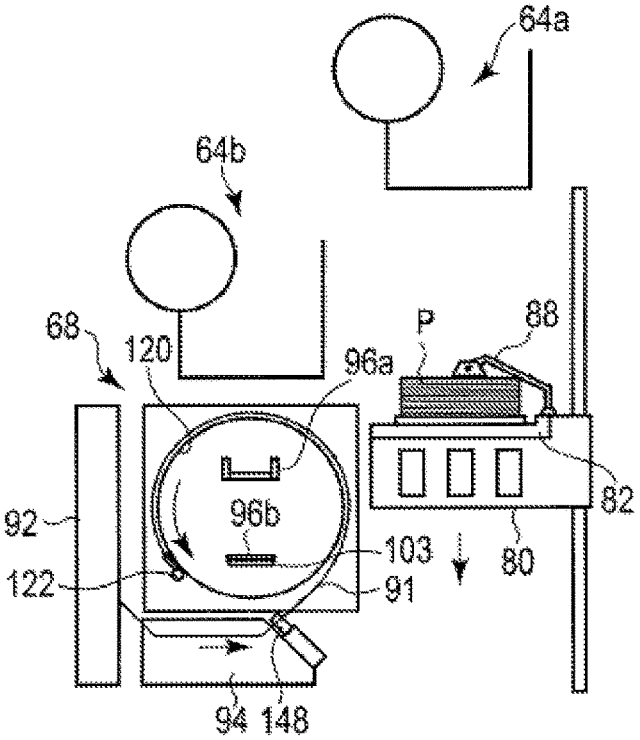
FIG. 40 is a side view of the stacking/wrapping apparatus schematically illustrating the stacking and wrapping operations.

If the 100 bills P are stacked in the first stacking device 64*a*, as shown in FIGS. 39 and 40, the stacked bills P are delivered from the first stacking device 64*a* onto the sheet carrier 82. After the stacked bill bundle P is then pressed and held on the sheet carrier 82 by the bill clampers 88, the base carrier 80 is lowered to the third position.

During the delivery and transport of the stacked bill bundle P, the wrapping device 68 rotates the ring gear 120 counterclockwise through the predetermined angle to move the band catcher 122 from the clamping position to the standby position, while delivering the wrapper band 91 by means of the band feed mechanism 94. Thereupon, the wrapper band 91 is drawn out in a loop along the ring gear 120 and located around the binding position. In this way, the looped wrapper band 91 is previously formed in the binding position as the stacked bill bundle P is transported from the first stacking device 64*a* to the wrapping device 68 by the transport carrier. Processing time for the entire stacking and wrapping operations can be reduced by previously setting the wrapper band 91 in a loop.

Figure 41:
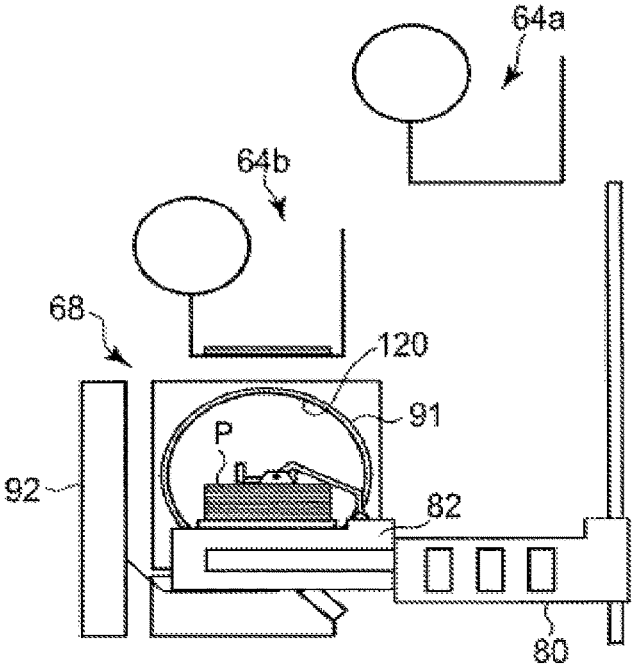
FIG. 41 is a side view of the stacking/wrapping apparatus schematically illustrating the stacking and wrapping operations.

Then, as shown in FIG. 41, the sheet carrier 82 advances from the standby position to the advanced position to move the stacked bill bundle P to a region above the release block 84 of the wrapping device. After the 100 bills are stacked by the first stacking device 64*a*, on the other hand, the 101-st and subsequent bills are stacked in parallel.

Subsequently, as shown in FIGS. 42 and 43, one longitudinal end portion of the stacked bill bundle P is held by the upper and lower hands 96*a* and 96*b* of the hand assembly 96, and the bill bundle P is received from the transport carrier. After the bill clampers 88 are then opened to release the hold, the sheet carrier 82 is moved from the advanced position to the standby position. In this way, the stacked bill bundle P is delivered to the wrapping device 68.

Figure 44:
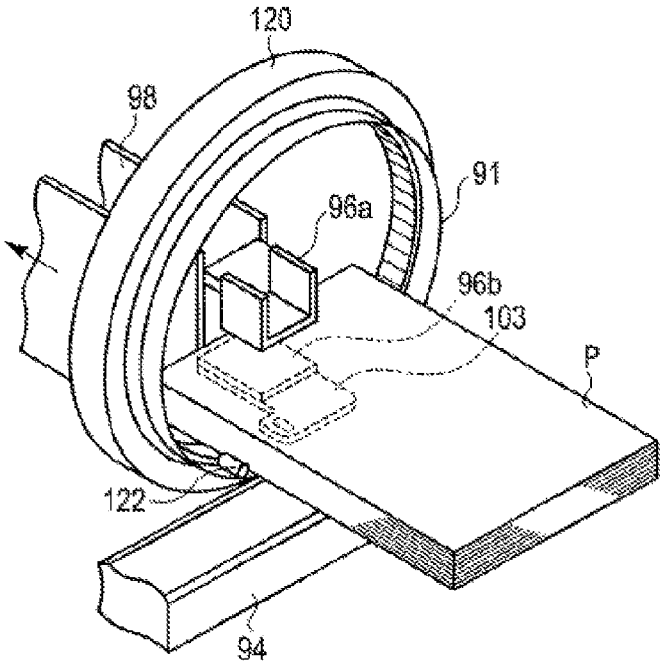
FIG. 44 is a perspective view showing how the bill bundle is drawn into a binding position by the hand assembly.

Thereafter, as shown in FIG. 44, the hand assembly 96 is moved from the advanced position to the retracted position, whereupon the bill bundle P is passed through the looped wrapper band 91 and drawn into the binding position. When the bill bundle P is moved to the binding position, the looped wrapper band 91 is located around the predetermined binding position of the bill bundle P. The support plate 103, which extends from the lower hand 96*b*, is located overlapping a sealing position for the bill bundle P. During the draw-in operation for the bill bundle P, the band catcher 122 and looped wrapper band 91 are located off the draw-in path for the bill bundle P and kept from hindering the draw-in operation.

Figure 45:
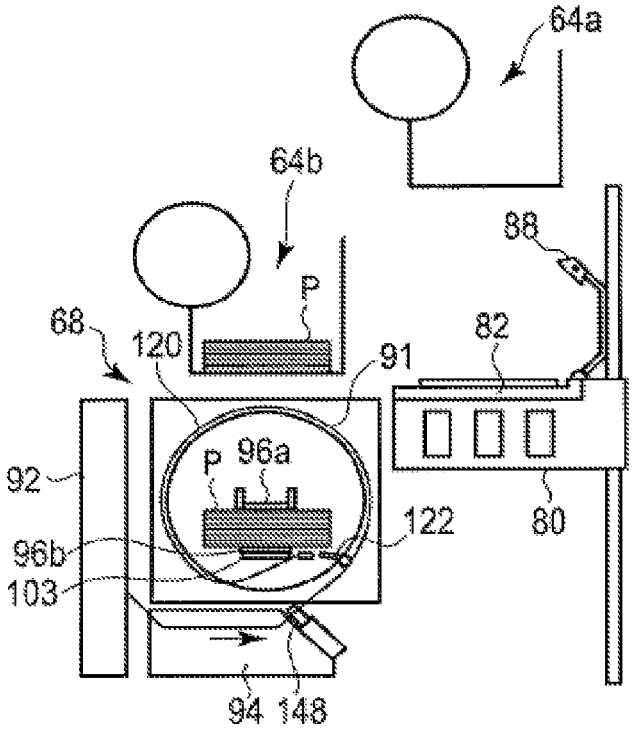
FIG. 45 is a side view of the stacking/wrapping apparatus schematically illustrating the stacking and wrapping operations.

After the stacked bill bundle P is drawn into the binding position, as shown in FIG. 45, the ring gear 120 is further rotated counterclockwise to move the band catcher 122 to the vicinity of the clamping position. The band catcher 122 is pivoted to the substantially horizontal position by the guide plate 150. In this way, the leading end of the wrapper band 91 clamped by the band catcher 122 gets in below the bill bundle P and is held there. The looped wrapper band 91 is located around the binding position for the stacked bill bundle P and in the position where it covers the support plate 103 on the hand assembly 96. Thus, the position of the band catcher 122 can be regulated by only rotating the ring gear 120. On the other hand, the base carrier 80 of the transport carrier is moved to and kept on standby in the second position where it faces the second stacking device 64*b*.

Figure 46:
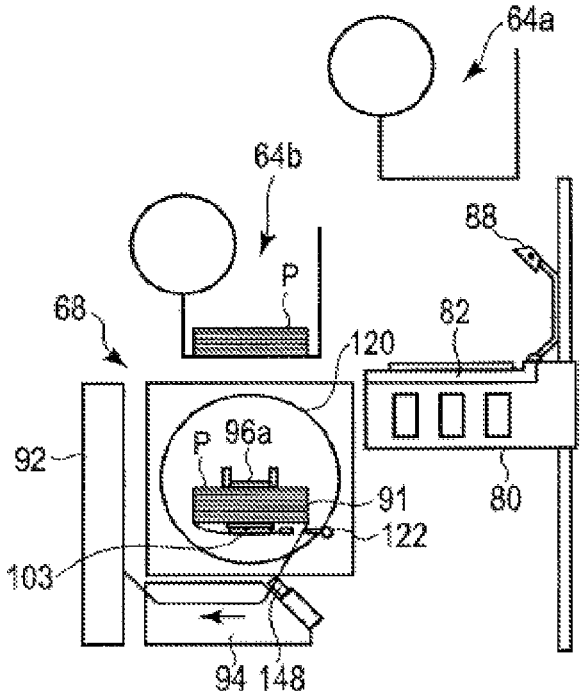
FIG. 46 is a side view of the stacking/wrapping apparatus schematically illustrating the stacking and wrapping operations.

Subsequently, as shown in FIG. 46, the wrapper band 91 is pulled back a certain distance by the band feed mechanism 94 such that the size of its loop is reduced, whereby the wrapper band is loosely wound around the bill bundle P and support plate 103.

Figure 47:
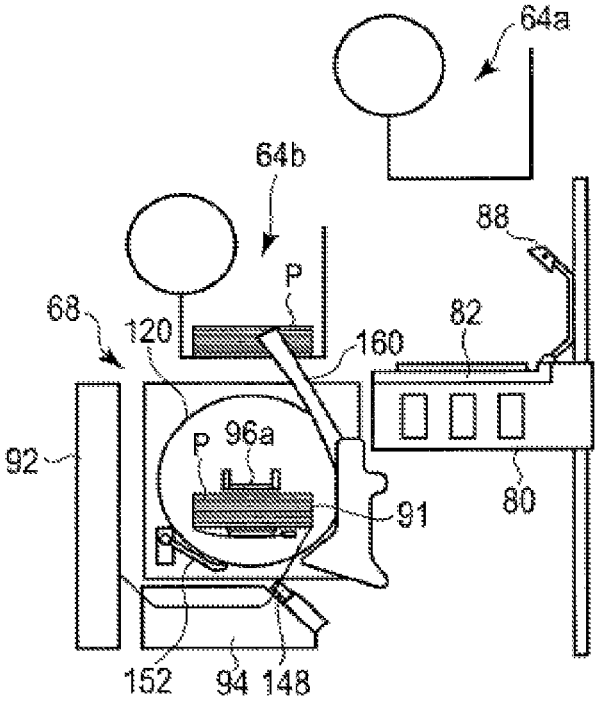
FIG. 47 is a side view of the stacking/wrapping apparatus schematically illustrating the stacking and wrapping operations.
Figure 48:
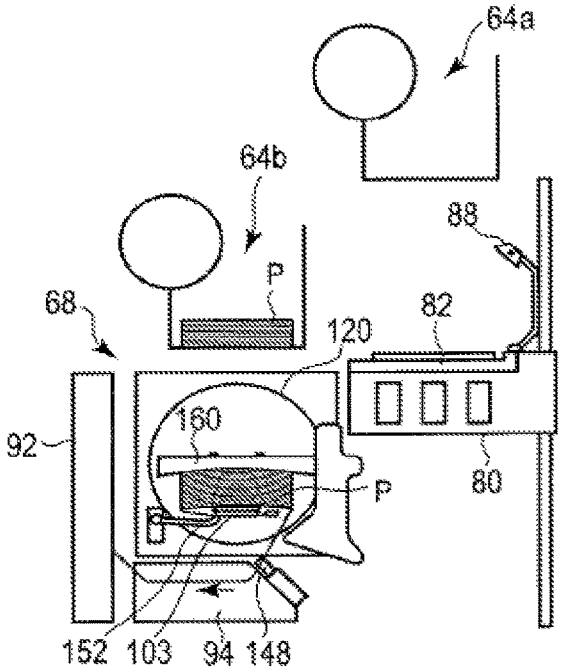
FIG. 48 is a side view of the stacking/wrapping apparatus schematically illustrating the stacking and wrapping operations.

Then, as shown in FIGS. 47 and 48, the first band retainer 152 is pivoted from the standby position to the retaining position by the first clamper drive mechanism 162, and the wrapper band 91 is pressed and held against the lower surface of the support plate 103 by the first band retainer. Since the surface hardness of the first band retainer 152 is higher than that of the support plate 103, frictional force can be produced by scratching (or forming small dents in) the lower surface of the support plate 103 so that the wrapper band 91 can be gripped without slipping, as shown in FIGS. 49 and 50.

Figure 49:
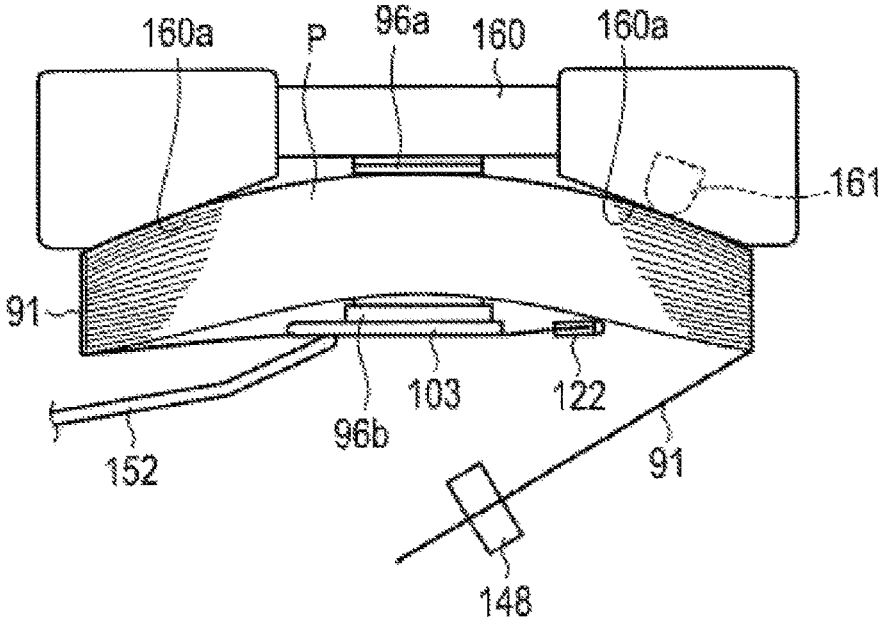
FIG. 49 is a front view showing how the bill bundle and a wrapper band are retained by the upper clamper and first band retainer.
Figure 50:
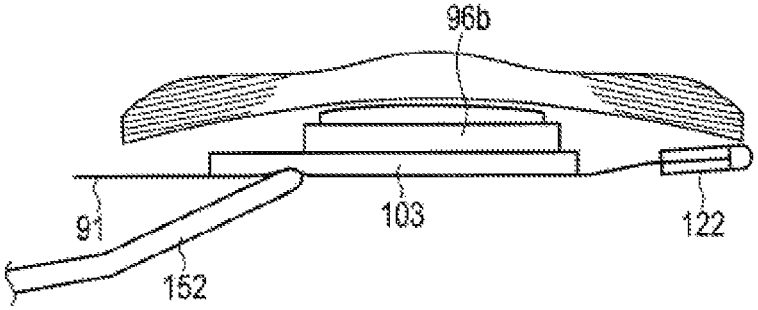
FIG. 50 is an enlarged front view showing how the first clamper drive mechanism abuts a support plate.

As shown in FIGS. 48 to 49, moreover, the upper clamper 160 is pivoted in association with the first band retainer 152 from the up position to the down-press position by the first clamper drive mechanism 162. In the up position, the upper clamper 160 is located off the transport paths for the stacked bill bundle P and wrapper band 91. In the down-press position, the upper clamper 160 presses the stacked bill bundle P grasped by the hand assembly 96 and the wrapper band 91 from above. The upper clamper 160 presses the stacked bill bundle P and wrapper band 91 from above so that the opposite side portions of the bill bundle P are curved downward. As this is done, the press member 161 in the upper clamper 160 abuts and presses the wrapper band 91 against the bill bundle P, thereby preventing slackening. In this state, the wrapper band 91 is further pulled back a certain distance by the band feed mechanism 94 to tighten the wrapper band wound around the bill bundle P.

Figure 51:
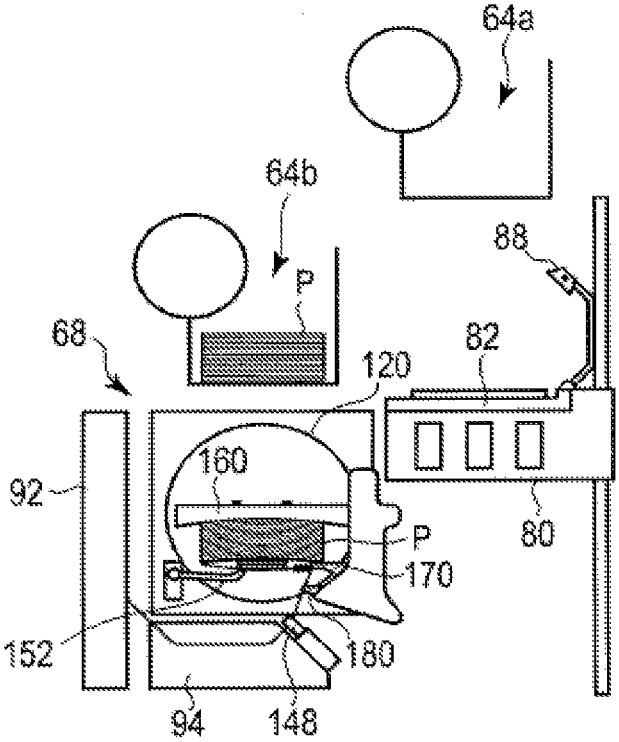
FIG. 51 is a side view of the stacking/wrapping apparatus schematically illustrating the stacking and wrapping operations.
Figure 52:
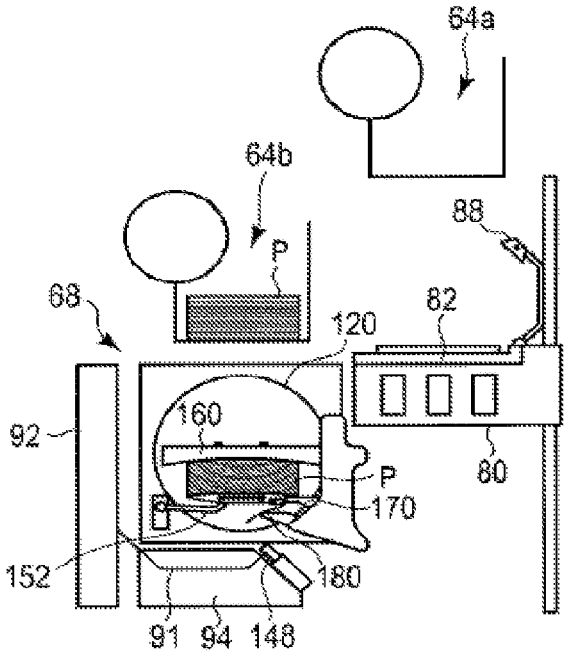
FIG. 52 is a side view of the stacking/wrapping apparatus schematically illustrating the stacking and wrapping operations.

Then, as shown in FIGS. 51 and 52, the second band retainer 170 is pivoted from the standby position to the retaining position by the second clamper drive mechanism 190, whereupon it presses and holds the trailing end portion of the wrapper band 91 against the lower right corner of the bill bundle P. In this state, the trailing end of the wrapper band 91 is cut by the cutter 148.

Figure 53:
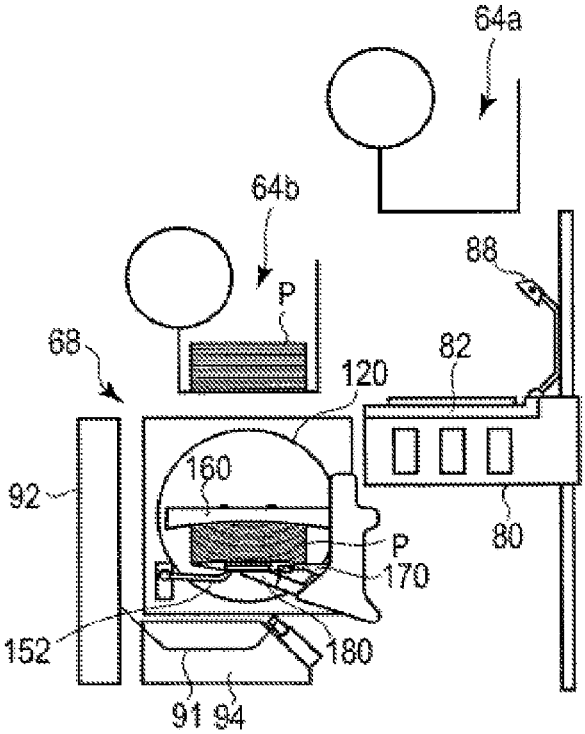
FIG. 53 is a side view of the stacking/wrapping apparatus schematically illustrating the stacking and wrapping operations.

Subsequently, as shown in FIGS. 52 and 53, the heater 180 is moved in association with the second band retainer 170 from the standby position to the heat-sealing position by the second clamper drive mechanism. The heater 180 moves to the heat-sealing position while pushing up the trailing end portion of the cut wrapper band 91 and presses the trailing end portion of the wrapper against the wound wrapper band in an overlapping manner. In this state, the overlapping portion of the wrapper band 91 is heat-sealed by the heater 180.

Figure 54:
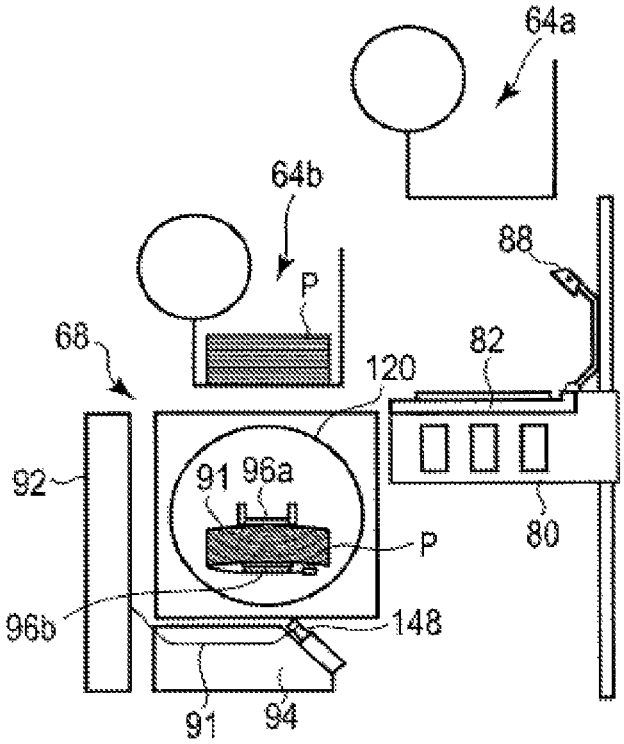
FIG. 54 is a side view of the stacking/wrapping apparatus schematically illustrating the stacking and wrapping operations.

After the wrapper band 91 is heat-sealed, as shown in FIG. 54, the first band retainer 152, upper clamper 160, second band retainer 170, and heater 180 are returned to their respective standby or up positions and kept apart from the stacked bill bundle P. As a press by the upper clamper 160 is released, the bill bundle P is restored from a curved state to a flat state. Thus, the wrapper band 91 can be tightened more firmly, so that the bill bundle P can be wrapped more securely.

When the wrapping of the stacked bill bundle P with the wrapper band 91 is finished, the hand assembly 96 grasping the stacked bill bundle P is moved forward, that is, toward the release block 84, from the drawn-in position at the predetermined speed by the hand drive mechanism 98, as shown in FIGS. 36A, 36B, and 36C. When the hand assembly 96 is advanced to the predetermined position, it is opened (or released) so that the hold on the bill bundle P is released. Thereupon, the bill bundle P is thrown out onto the release block 84. Then, the ejector lever 202 is pivoted from the standby position to the press position by the discharge mechanism 200, whereupon the trailing end of the stacked bill bundle P on the release block 84 is pressed by the ejector lever 202. Thus, the stacked bill bundle P on the release block is discharged to the outside of the apparatus.

Figure 55:
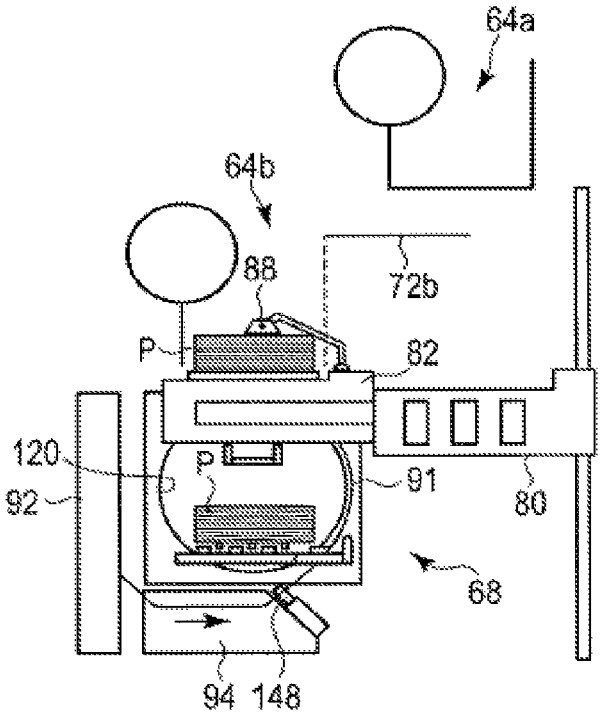
FIG. 55 is a side view of the stacking/wrapping apparatus schematically illustrating the stacking and wrapping operations.
Figure 56:
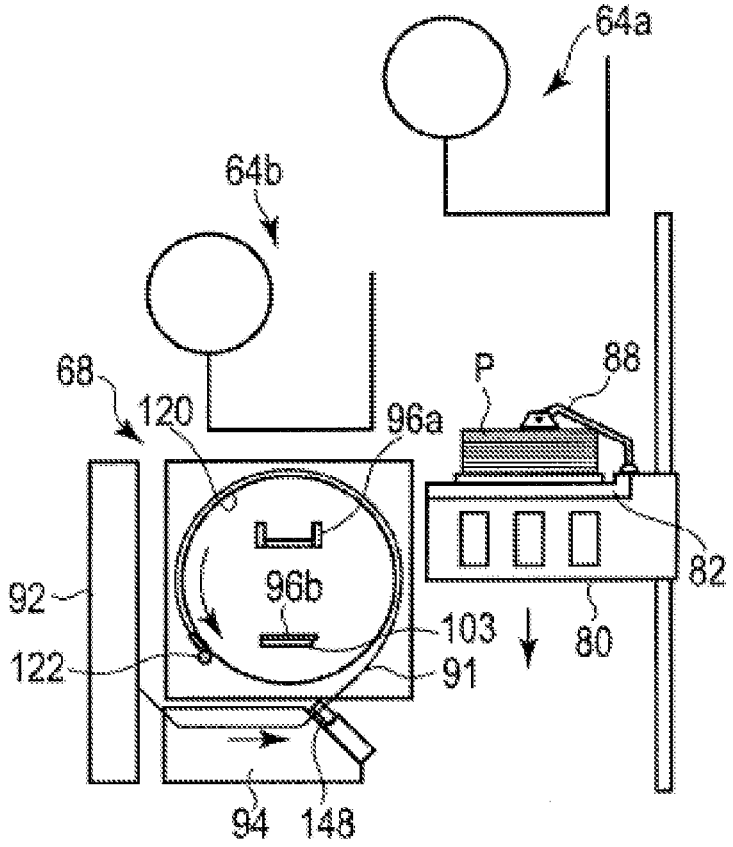
FIG. 56 is a side view of the stacking/wrapping apparatus schematically illustrating the stacking and wrapping operations.

After the bill bundle P is thrown out onto the release block 84, as shown in FIGS. 55 and 56, moreover, the next wrapper band 91 is delivered by the band feed mechanism 94 of the band feeder and its leading end is grasped by the band catcher 122. Then, the ring gear 120 is pivoted counterclockwise to move the band catcher 122 from the clamping position to the standby position, thereby forming the looped wrapper band 91. As this is done, the stacked bill bundle P is received from the second stacking device 64*b* by the transport carriers 80 and 82, and moreover, it is transported to a position where it faces the wrapping device 68.

Thereafter, the bill bundle P is delivered to the wrapping device 68, whereupon the wrapper band 91 is wound around the bill bundle P to wrap it in the same manner as described above.

Thus, the stacking/wrapping module 60 stacks and wraps fit or unfit bills from the main module 10 and sorting module 30 in a predetermined number at a time, according to denomination and fitness, and feeds bundles (or wads) of bills. The wrapped bill bundles are discharged into and successively stacked in layers in the discharge unit 73 below the stacking/wrapping module.

As shown in FIG. 1, the large-capacity stacking module 174, which is disposed downstream relative to the stacking/wrapping module 60, comprises a transport path 141 and large-capacity stacking chamber 175. The bills P fed from the stacking/wrapping module 60 are transported through the pick-up mechanism 14. A fixed number of bills individually transported through the transport path 141 can be stacked in the stacking chamber 175.

A safety pocket 176 is disposed most downstream of all the modules. If there is any bill having failed to be processed during the transport through the modules, it is discharged into the safety pocket 176 and removed from the apparatus.

According to the bill processing apparatus constructed in this manner, paper sheets can be picked up so stably that its reliability can be improved. In the bill processing apparatus, moreover, the first and second stacking devices are offset obliquely relative to each other and the bills stacked by the first and second stacking devices are transported to the wrapping device by means of the common transport mechanism. Thus, the stacking/wrapping apparatus can be made space-saving and miniaturized. In the stacking/wrapping apparatus, moreover, the stacking and wrapping operations can be can be speeded up, and each bill bundle can be wrapped in, for example, 6 seconds or less.

The looped wrapper band can be previously formed while the bill bundle is being transported by the transport carrier so that the wrapper band can start to be wound immediately after its delivery. Thus, the transport carrier can immediately start to receive the next bill bundle, so that the processing time can be reduced. Since the hand assembly is constructed so that the operating quantity of the lower hand is smaller than that of the upper hand, it can easily receive and reliably clamp thick or swollen bills. Further, the moved position of the band catcher can be easily set by controlling the rotation of the ring gear. Furthermore, the wrapper band can be pressed and held in a suitable position by the first and second band retainers, and it can be wound within a relatively small area. Thus, according to the present embodiment, there can be provided a miniaturizable stacking/wrapping apparatus capable of high-speed processing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the paper sheets to be processed are not limited to bills and batch cards and may alternatively be casino cards, securities, etc. Further, the bill processing apparatus may alternatively comprise a plurality of stacking/wrapping modules that are arranged side by side.

What is claimed is:

1. A stacking/wrapping apparatus comprising:

a stacking device configured to stack paper sheets in a predetermined number on a stacking unit;

a wrapping device configured to wrap a bundle of the stacked paper sheets by winding a band thereon; and a transport carrier configured to receive the paper sheet bundle stacked by the stacking device and transport the paper sheet bundle to the wrapping device, the wrapping device comprising a hand assembly capable of pinching end portions of the paper sheet bundle transported by the transport carrier and drawing the paper sheet bundle into a predetermined binding position, a hand drive mechanism configured to open and close the hand assembly in a stacking direction of the paper sheet bundle and reciprocate the hand assembly in a direction cross to the stacking direction, and a band winding device configured to wind a wrapper band around the paper sheet bundle drawn into the binding position, the transport carrier being configured to move to a receiving position facing the stacking device and receive another paper sheet bundle from the stacking device while the band is being wound around the paper sheet bundle by the wrapping device after the paper sheet bundle is grasped by the hand assembly;

the hand assembly comprising an upper hand and a lower hand opposed to each other with a gap therebetween and individually supported for up-and-down motion, and the hand drive mechanism comprises a motor, a large gear and a small gear disposed coaxially with each other and rotatable about the same axis by the motor, the small gear being smaller in diameter than the large gear, a first rack connected to the upper hand and engaging with the large gear, and a second rack connected to the lower hand and engaging with the small gear, the first and second racks being located parallel to each other with respective rotating shafts of the large and small gears therebetween, the amount of up-and-down motion of the upper hand by the hand drive mechanism being greater than that of the lower hand.

2. The stacking/wrapping apparatus of claim 1, wherein the transport carrier is configured to be capable of up-and-down motion and horizontal movement between the receiving position to receive the paper sheet bundle stacked in the stacking device and a delivery position facing the wrapping device.

3. The stacking/wrapping apparatus of claim 1, wherein the wrapping device comprises a ring gear rotatable about an axis parallel to a direction of reciprocation of the hand assembly, a band feeder configured to deliver the wrapper band to the vicinity of the ring gear and pull back the wrapper band, a band catcher mounted on the ring gear so as to be rotatable together with the ring gear and configured to clamp a leading end of the wrapper band delivered from the band feeder, and a band drive mechanism configured to rotate the ring gear and deliver the wrapper band from the band feeder with the leading end of the wrapper band clamped by the band catcher, thereby forming a looped wrapper band along the ring gear in the binding position, and the hand assembly is configured to draw the paper sheet bundle into the looped wrapper band.

4. The stacking/wrapping apparatus of claim 3, wherein the band drive mechanism previously forms the looped wrapper band in the binding position while the paper sheet bundle is being transported from the stacking device to the wrapping device by the transport carrier.

5. The stacking/wrapping apparatus of claim 4, wherein the band catcher is configured to be moved to a standby position off a draw-in path for the paper sheet bundle after moving from a clamping position to clamp the leading end of the band to a position to form the looped wrapper band as the ring gear rotates in one direction and be pivoted to and held in a horizontal position where the band catcher abuts a guide plate and lies below the paper sheet bundle as the ring gear further rotates in the one direction.

6. The stacking/wrapping apparatus of claim 5, wherein the wrapping device comprises a support plate extending from the lower hand and located between the paper sheet bundle and the wrapper band and a first band retainer rotatable between a standby position off the draw-in path for the paper sheet bundle and a retaining position to press the wrapper band against the support plate, and the band feeder pulls back the wrapper band a certain distance and winds the wrapper band around the paper sheet bundle in such a manner that the band catcher clamping the leading end of the band is held in the horizontal position and the wrapper band is pressed against the support plate by the first band retainer.

7. The stacking/wrapping apparatus of claim 6, wherein the first band retainer includes a surface hardness higher than that of the support plate.

8. The stacking/wrapping apparatus of claim 6, wherein the wrapping device comprises an upper clamper configured to press the wrapper band and the paper sheet bundle from above in the binding position and depresses opposite longitudinal side portions of the paper sheet bundle toward the support plate, thereby curving the entire paper sheet bundle, and a first clamper drive mechanism configured to cause the upper clamper to ascend and descend synchronously with the first band retainer.

9. The stacking/wrapping apparatus of claim 8, wherein the band feeder pulls back the wrapper band a certain distance to tighten the paper sheet bundle pressed by the upper clamper, and the wrapping device comprises a second band retainer configured to press and hold the tightened wrapper band against the paper sheet bundle, a heater configured to heat and seal a seam of the pressed wrapper band, and a second clamper drive mechanism configured to move the second band retainer and the heater in association with each other to a position where the second band retainer and the heater abut the wrapper band.

10. The stacking/wrapping apparatus of claim 9, wherein the wrapping device comprises a cutter configured to cut the wrapper band between the second band retainer and the band feeder.

11. The stacking/wrapping apparatus of claim 9, wherein the upper clamper comprises a press member located opposite the second band retainer with the paper sheet bundle therebetween and configured to press and hold the wrapper band against the paper sheet bundle from above.

12. The stacking/wrapping apparatus of claim 11, wherein the wrapping device comprises a release block onto which the wrapped paper sheet bundle is to be thrown out and an ejector lever disposed on the release block and configured to discharge the paper sheet bundle to the outside of the device, and the hand drive mechanism is configured to push out the hand assembly and the paper sheet bundle grasped thereby toward the release block and releases the hand assembly after the paper sheet bundle is bound with the wrapper band and throws out the wrapped paper sheet bundle onto the release block.

* * * * *